US011777201B2

(12) United States Patent
Tang et al.

(10) Patent No.: US 11,777,201 B2
(45) Date of Patent: Oct. 3, 2023

(54) APPARATUS, SYSTEM, AND METHOD FOR TRANSFERRING RADIO FREQUENCY SIGNALS BETWEEN WAVEGUIDES AND RADIATING ELEMENTS IN ANTENNAS

(71) Applicant: Meta Platforms, Inc., Menlo Park, CA (US)

(72) Inventors: Qi Tang, Los Angeles, CA (US); Srishti Saraswat, Santa Clara, CA (US); Farbod Tabatabai, San Francisco, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 182 days.

(21) Appl. No.: 17/408,195

(22) Filed: Aug. 20, 2021

(65) Prior Publication Data

US 2022/0069455 A1 Mar. 3, 2022

Related U.S. Application Data

(60) Provisional application No. 63/074,339, filed on Sep. 3, 2020.

(51) Int. Cl.

| | |
|---|---|
| ***H01Q 1/38*** | (2006.01) |
| ***H01Q 21/00*** | (2006.01) |
| ***H01Q 13/10*** | (2006.01) |
| *H01Q 23/00* | (2006.01) |

(52) U.S. Cl.

CPC ..... *H01Q 1/38* (2013.01); *H01Q 13/10* (2013.01); *H01Q 21/0006* (2013.01); *H01Q 23/00* (2013.01)

(58) Field of Classification Search

CPC ..... H01Q 1/38; H01Q 13/10; H01Q 21/0006; H01Q 23/00; H01P 5/107; H01P 5/028

See application file for complete search history.

(56) References Cited

U.S. PATENT DOCUMENTS

| | | | | |
|---|---|---|---|---|
| 2012/0206219 | A1* | 8/2012 | Choi | H01P 5/107 333/230 |
| 2020/0251798 | A1 | 8/2020 | Sakurai et al. | |
| 2022/0077557 | A1* | 3/2022 | Rousstia | H05K 1/0251 |

FOREIGN PATENT DOCUMENTS

| | | | |
|---|---|---|---|
| JP | H04802 | A | 1/1992 |
| WO | 2020095092 | A1 | 5/2020 |
| WO | 2020122723 | A1 | 6/2020 |

OTHER PUBLICATIONS

Tang, Qi, "Apparatus, System, and Method for Implementing Receive and Transmit Antenna Elements in a Single Aperture", U.S. Appl. No. 17/355,888 dated Jun. 23, 2021, 51 pages.

(Continued)

*Primary Examiner* — David E Lotter

(74) *Attorney, Agent, or Firm* — Greenberg Traurig, LLP

(57) ABSTRACT

A radio frequency coupling structure comprising (1) a substrate that forms a top side of a waveguide, (2) a first conductive layer disposed on a bottom side of the substrate, (3) a second conductive layer incorporated within the substrate, (4) a through via that is communicatively coupled to the first conductive layer and extends through an opening in the second conductive layer toward a top side of the substrate, and/or (5) a ring slot formed around the through via in the first conductive layer. Various other apparatuses, systems, and methods are also disclosed.

20 Claims, 13 Drawing Sheets

(56) References Cited

OTHER PUBLICATIONS

Tabatabai et al., "Apparatus, System, and Method for Preventing Radio Frequency Energy Leaks and Intrusions Via Choke Structures", U.S. Appl. No. 17/393,431 dated Aug. 4, 2021, 59 pages.
Tang et al., "Apparatus, System, and Method for Transferring Radio Frequency Signals Between Parallel Waveguides in Antennas", U.S. Appl. No. 17/388,237 dated Jul. 29, 2021, 64 pages.
Tabatabai, Farbod, "Apparatus, System, and Method for Transferring Radio Frequency Signals Between Waveguides and Patch Structures in Antennas", U.S. Appl. No. 17/384,297 dated Jul. 23, 2021, 62 pages.
McGuyer et al., "Apparatus, System, and Method for Beam-Steering via Moire Patterns", U.S. Appl. No. 17/354,864 dated Jun. 22, 2021, 54 pages.
Tabatabai et al., "Apparatus, System, and Method for Facilitating Satellite Handover via Hybrid Antenna Structures", U.S. Appl. No. 17/354,868 dated Jun. 22, 2021, 54 pages.
International Search Report and Written Opinion for International Application No. PCT/US2021/048612, dated Feb. 11, 2022, 16 pages.
Invitation to Pay Additional Fees for International Application No. PCT/US2021/048612, dated Dec. 14, 2021, 12 pages.
Kapusuz K.Y , et al., "Polarization Reconfigurable Air-Filled Substrate Integrated Waveguide Cavity-Backed Slot Antenna," IEEE Access, vol. 7, Jul. 3, 2019, pp. 102628-102643.
International Preliminary Report on Patentability for International Application No. PCT/US2021/048612, dated Mar. 16, 2023, 12 pages.

* cited by examiner

APPARATUS, SYSTEM, AND METHOD FOR TRANSFERRING RADIO FREQUENCY SIGNALS BETWEEN WAVEGUIDES AND RADIATING ELEMENTS IN ANTENNAS

INCORPORATION BY REFERENCE

This application claims the benefit of U.S. Provisional Application No. 63/074,339, filed on Sep. 3, 2020, the disclosure of which is incorporated in its entirety by this reference.

BRIEF DESCRIPTION OF DRAWINGS

The accompanying drawings illustrate a number of exemplary embodiments and are a part of the specification. Together with the following description, these drawings demonstrate and explain various principles of the present disclosure.

Figure 1:
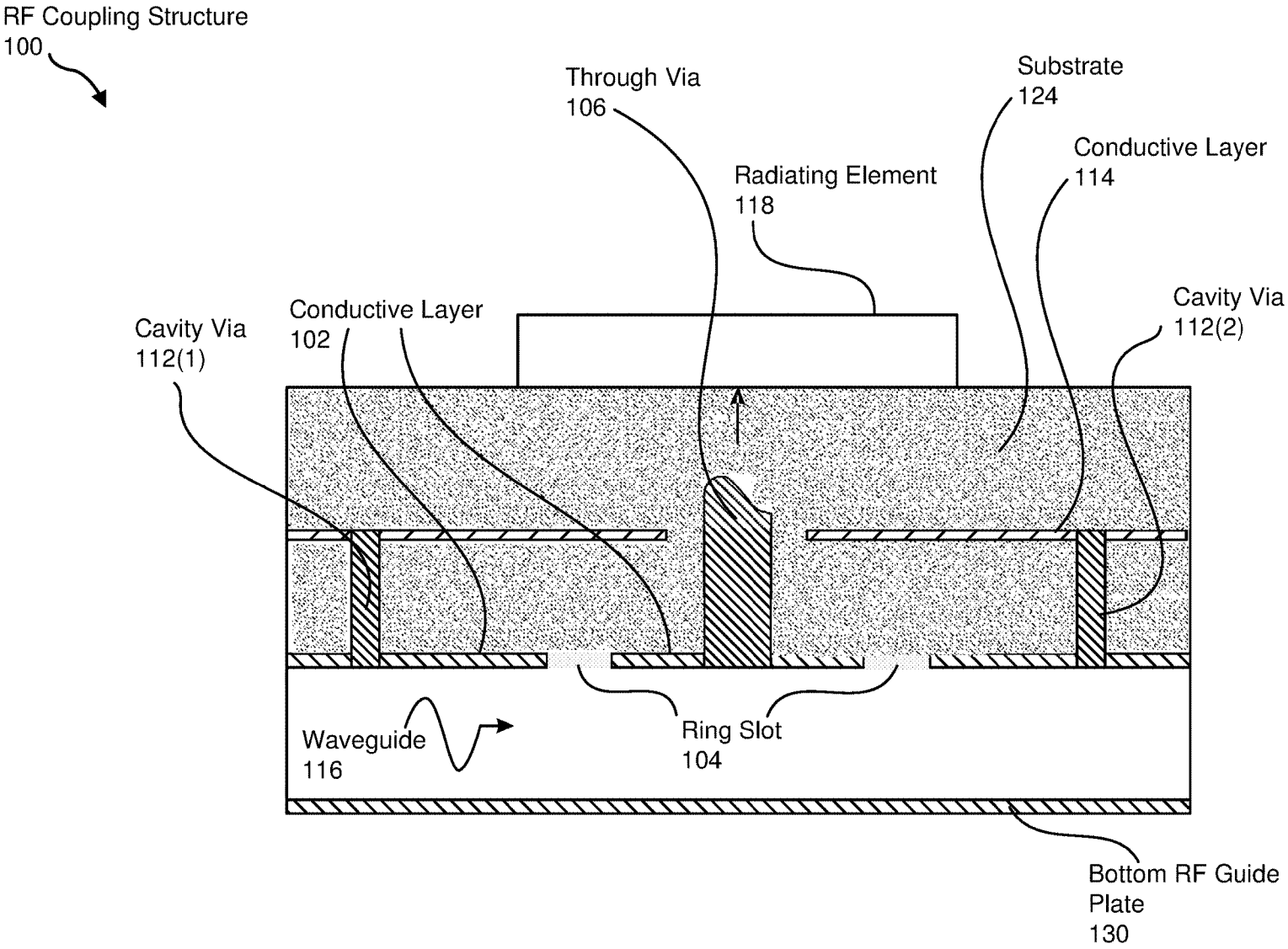
FIG. 1 is an illustration of an exemplary radio frequency (RF) coupling structure that facilitates transferring RF signals between a waveguide and a radiating element in an antenna in accordance with one or more embodiments of this disclosure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within this disclosure.

DETAILED DESCRIPTION OF EXEMPLARY EMBODIMENTS

The present disclosure is generally directed to apparatuses, systems, and methods for transferring RF signals between waveguides and radiating elements in antennas. As will be explained in greater detail below, these apparatuses, systems, and methods may provide numerous features and benefits. An important aspect of waveguide-fed RF antenna design is often the RF coupling structure that is driven by an RF signal propagating in a waveguide. Such an RF coupling structure may emit RF energy by way of a corresponding radiating element as a transmitted signal from the antenna. In at least some examples, the same or similar combination of radiating element and coupling structure may also be employed to receive an RF signal and/or transfer that signal to a waveguide for amplification, down-conversion, and other signal processing.

The development of the coupling structure may become even more critical in a mechanically steerable antenna (MSA). In some examples, an MSA may include and/or implement an array of coupling structures and corresponding radiating elements located within an aperture of the antenna. In such examples, the array of coupling structures and corresponding radiating elements may collectively radiate to transmit an RF signal along a particular antenna boresight defined by the orientation of various portions of the antenna, as described more fully below.

The present disclosure is generally directed to an annular ring slot RF coupling structure that couples an RF signal propagating in a waveguide to a radiating element such that acceptable signal gain performance is achieved at a number of angles at which the RF signal is received in the waveguide at the coupling structure. Within the environment of an MSA, the coupling structure may couple a nominal amount of energy from the waveguide to the radiating element, thereby resulting in an optimal gain for the antenna aperture and/or potentially facilitating an overall low power consumption and/or physical size for the MSA. However, in other embodiments, other types of antennas may also benefit from application of the various embodiments of the annular ring slot coupling structure described herein.

The following will provide, with reference to FIGS. 1-12, detailed descriptions of exemplary apparatuses, systems, components, and structures for transferring RF signals between waveguides and radiating elements in antennas. In addition, detailed descriptions of exemplary methods for transferring RF signals between waveguides and radiating elements in antennas will be provided in connection with FIG. 13.

FIG. 1 illustrates a side-view cross section of an exemplary RF coupling structure 100 for coupling a waveguide 116 to a radiating element 118 of an antenna. In some examples, RF coupling structure 100 may enable RF signals to traverse and/or travel from waveguide 116 to radiating element 118 for transmission from the antenna. Additionally or alternatively, RF coupling structure 100 may enable RF signals to traverse and/or travel from radiating element 118 to waveguide 116 for reception at the antenna.

Figure 11:
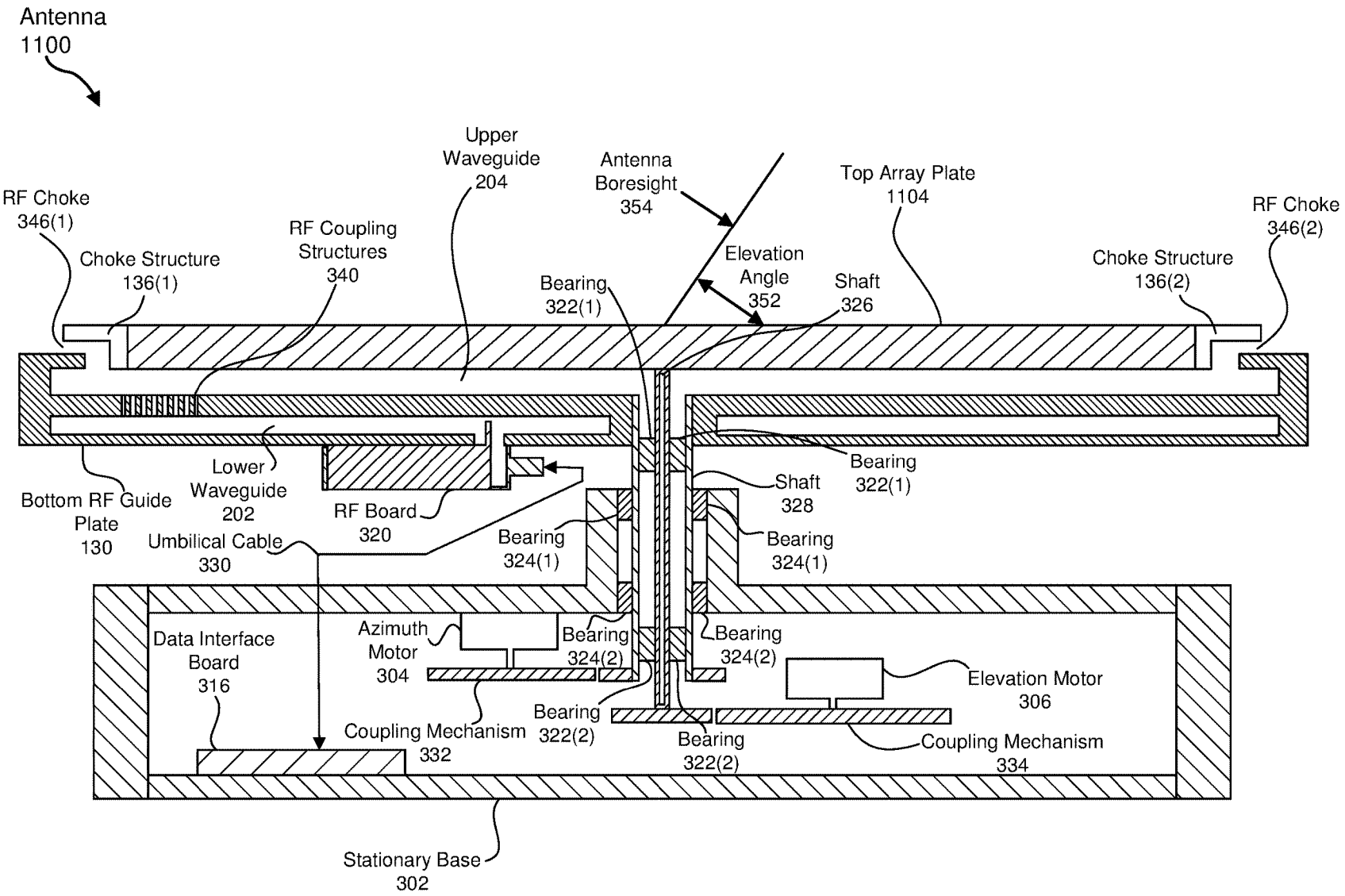
FIG. 11 is an illustration of an additional exemplary antenna that includes coupling structures that facilitate transferring RF signals between waveguides and radiating elements in accordance with one or more embodiments of this disclosure.

As illustrated in FIG. 11, RF coupling structure 100 may include and/or represent a substrate 124 that forms, defines, and/or establishes a top side of waveguide 116. RF coupling structure 100 may also include and/or represent a bottom RF guide plate 130 that forms, defines, and/or establishes a bottom side of waveguide 116. In some examples, RF coupling structure 100 may include and/or represent a conductive layer 102 disposed, attached, and/or applied on a bottom side of substrate 124. In such examples, RF coupling structure 100 may include and/or represent a conductive layer 114 disposed, embedded, and/or incorporated within and/or inside substrate 124. In one example, RF coupling structure 100 may also include and/or represent a through via 106 that is communicatively and/or conductively coupled to conductive layer 102. In this example, through via 106 may extend, continue, and/or pass through an opening in conductive layer 114 toward radiating element 118.

In some examples, RF coupling structure 100 may include and/or represent a ring slot 104 formed, cut, etched, and/or milled around through via 106 in conductive layer 102. In one example, ring slot 104 may expose substrate 124 to waveguide 116. In this example, at least a portion of conductive layer 102 may be removed, etched, and/or milled away to form ring slot 104 and/or expose substrate 124 to waveguide 116. In one embodiment, ring slot 104 may include and/or represent a whole annular slot that completely encompasses and/or surrounds through via 106 in conductive layer 102. In another embodiment, ring slot 104 may encompass and/or surround a majority of through via 106 in conductive layer 102 and also include and/or incorporate a break in which conductive material from conductive layer 102 remains intact.

In some examples, RF coupling structure 100 may include and/or represent multiple cavity vias, such as cavity vias 112(1) and 112(2), which may also be referred to as stitching vias. In such examples, the cavity and/or stitching vias may be communicatively and/or conductively coupled between conductive layers 102 and 114. In one example, the cavity and/or stitching vias may be electroplated to establish conductivity and/or continuity across conductive layers 102 and 114. Additionally or alternatively, the cavity and/or stitching vias may be arranged and/or organized radially or circularly around ring slot 104 and/or through via 106 within substrate 124.

In some examples, radiating element 118 may be coupled, attached, and/or interfaced to the top side of substrate 124. In such examples, radiating element 118 may radiate and/or emit electromagnetic energy in accordance with RF signals traversing and/or travelling through waveguide 116. For example, an RF signal may traverse and/or travel through waveguide 116 and then pass through ring slot 104 to substrate 124. In this example, the RF signal may radiate across substrate 124 through the opening that exists between conductive layer 114 and through via 106. Radiating element 118 may then radiate and/or emit electromagnetic energy from this RF signal. The electromagnetic energy radiated and/or emitted by radiating element 118 may take the form of an RF signal transmitted to a passing satellite.

In some examples, cavity vias 112(1) and 112(2) may span and/or run across and/or through portions of substrate 124 to provide electrical conductivity and/or continuity between conductive layers 102 and 114. In one example, cavity vias 112(1) and 112(2) may each include and/or represent a drilled hole that has been fully or partially plated with electrically conductive material to create and/or form a conductive path and/or bridge from one or more of conductive layers 102 and 114.

In some examples, cavity vias 112(1) and 112(2) may span and/or run across and/or through portions of substrate 124 to provide electrical conductivity and/or continuity between conductive layers 102 and 114. In one example, cavity vias 112(1) and 112(2) may each include and/or represent a drilled hole that has been fully or partially plated or filled with electrically conductive material to create and/or form a conductive path and/or bridge from one or more of conductive layers 102 and 114.

In some examples, through via 106 may span and/or run across and/or through a portion of substrate 124 to direct, guide, and/or feed RF signals between waveguide 116 and radiating element 118. In one example, through via 106 may each include and/or represent a drilled hole that has been fully or partially plated or filled with electrically conductive material to create and/or form a conductive path and/or bridge through a certain portion of substrate 124. In this example, through via 106 may extend beyond conductive layer 114 toward radiating element 118.

In some examples, RF coupling structure 100 may include and/or represent various planes and/or layers that facilitate carrying, directing, and/or transferring electric current and/or RF signals in an antenna. In such examples, RF coupling structure 100 may include and/or contain a variety of materials. Some of these materials may conduct electricity. Other materials included in RF coupling structure 100 may insulate the conductive materials from one another.

In some examples, each electrically conductive layer may include and/or represent a plane of conductive material that is etched during the fabrication phase to produce various conductive planes, paths, traces, cutouts, and/or holes. Examples of such electrically conductive materials include, without limitation, copper, aluminum, silver, gold, alloys of one or more of the same, combinations or variations of one or more of the same, and/or any other suitable materials.

In some examples, RF coupling structure 100 may include and/or incorporate insulating material that facilitates mounting (e.g., mechanical support) and/or interconnection (e.g., electrical and/or RF coupling) of electrical and/or RF components. In one example, RF coupling structure 100 may include and/or represent a printed circuit board (PCB). Additionally or alternatively, substrate 124 may include and/or represent insulation material that electrically insulates through via 106 and conductive layer 102 or conductive layer 114 from one another. In certain embodiments, the insulation material may constitute and/or represent a dielectric substance that is a poor conductor of electricity and/or is polarized by an applied electric field.

Dielectric substances may be implemented as solids, liquids, and/or gases. Examples of dielectric substances include, without limitation, porcelains, glasses, plastics, industrial coatings, silicon, germanium, gallium arsenide, mica, metal oxides, silicon dioxides, sapphires, aluminum oxides, polymers, ceramics, variations or combinations of one or more of the same, and/or any other suitable dielectric materials.

In some examples, RF coupling structure 100 may be fabricated in any of a variety of ways, including sequential lamination. For example, as part of a sequential lamination process, RF coupling structure 100 may be fabricated layer by layer, using certain subcomposites of copper and insulating materials. In this example, the sequential lamination process may facilitate trace routing and/or via drilling within internal planes and/or layers.

In some examples, waveguide 116 may direct an RF signal generated by an RF board (e.g., RF board 320 in FIG. 11) toward RF coupling structure 100, which facilitates and/or supports the transmission of the RF signal. In other examples, waveguide 116 may direct an RF signal received by an antenna (e.g., antenna 1100 in FIG. 11) from RF coupling structure 100 to the RF board.

In some examples, radiating element 118 may include and/or represent a radiation channel, gateway, and/or passage that supports propagating electromagnetic energy and/or waves. In one example, radiating element 118 may be activated and/or deactivated to control which path the electromagnetic energy and/or waves are to traverse through the antenna structure. Additionally or alternatively, radiating element 118 may propagate electromagnetic waves to form and/or establish a receive and/or transmit beam steered to track a passing satellite.

Radiating element 118 may include and/or contain any of a variety of materials. Examples of such materials include, without limitation, metals, plastics, ceramics, polymers, composites, rubbers, variations or combinations of one or more of the same, and/or any other suitable materials.

Figure 2:
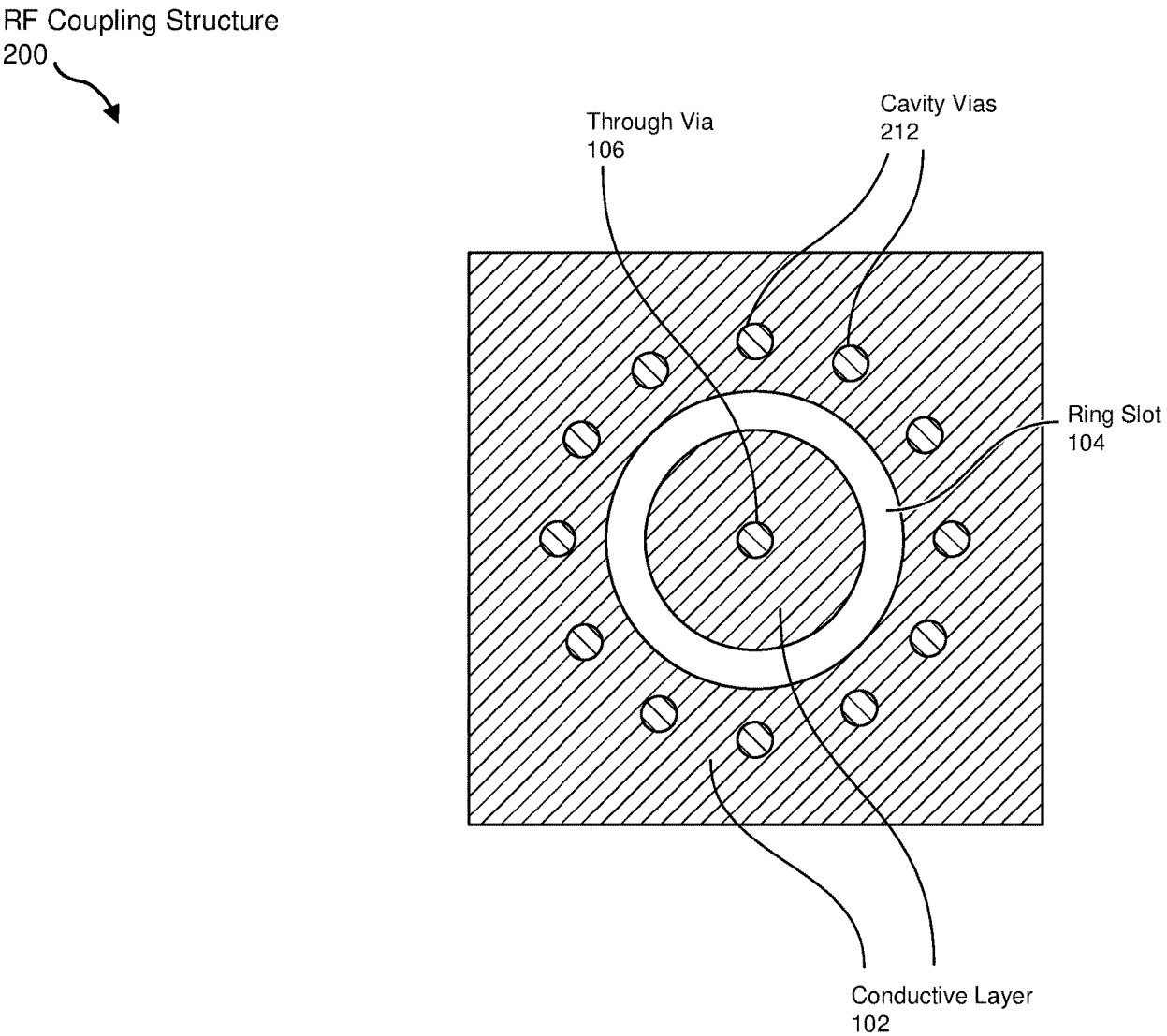
FIG. 2 is an illustration of an additional exemplary RF coupling structure that facilitates transferring RF signals between a waveguide and a radiating element in an antenna in accordance with one or more embodiments of this disclosure.

FIG. 2 illustrates a top-view cross section of an exemplary RF coupling structure 200 for coupling a waveguide to a radiating element of an antenna. As illustrated in FIG. 2, RF coupling structure 200 may include and/or represent conductive layer 102 disposed, attached, and/or applied on a bottom side of substrate 124 (not necessarily labelled in FIG. 2). In some examples, RF coupling structure 200 may include and/or represent through via 106 that is communicatively and/or conductively coupled to conductive layer 102.

In some examples, RF coupling structure 200 may include and/or represent ring slot 104 formed, cut, etched, and/or milled around through via 106 in conductive layer 102. In one example, ring slot 104 may expose substrate 124 to waveguide 116. In this example, at least a portion of conductive layer 102 may be removed, etched, and/or milled away to form ring slot 104 and/or expose substrate 124 to waveguide 116. In one embodiment, ring slot 104 may include and/or represent a whole annular slot that completely encompasses and/or surrounds through via 106 in conductive layer 102.

In some examples, RF coupling structure 200 may include and/or represent cavity vias 212 that are communicatively and/or conductively coupled between conductive layers 102 and 114. In one example, cavity vias 212 may be electroplated to establish conductivity and/or continuity across conductive layers 102 and 114. Additionally or alternatively, cavity vias 212 may be arranged and/or organized radially or circularly around ring slot 104 and/or through via 106.

In some embodiments, a plurality of these coupling structures may be incorporated within a PCB (e.g., serving as at least a portion of top array plate 1104 of antenna 1100 in FIG. 11). In one example, the PCB may incorporate a nonconductive (e.g., dielectric) substrate material that includes a bottom metal layer and a middle metal layer (e.g., copper or another conductor). The bottom metal layer may serve as the upper wall of the upper cavity (e.g., upper waveguide 204 of antenna 1100 in FIG. 11) between the top array plate and the bottom RF guide plate.

In some examples, through via 106 may be connected to an isolated circular portion of metal at the bottom metal layer and/or may be surrounded by ring slot 104 defining an absence of metal in the bottom metal layer. In one example, through via 106 may also extend upward through a hole in the middle metal layer and/or terminate at a radiating element (e.g., a radiating patch element, a single-arm spiral element, or another element) that resides atop the PCB substrate, thus operating as a feeding pin for the radiating element. Further, the middle metal layer may shield and/or isolate the remainder of the coupling structure from the radiating element, thus reducing and/or eliminating any negative impact that the operation of the coupling structure may otherwise have on the performance of the radiating element, such as the axial ratio and/or beam pattern of the radiating element.

In some examples, cavity vias 212 may surround ring slot 104 (e.g., in a radial and/or circular pattern) as viewed from the top and/or bottom of the PCB. While twelve cavity vias are depicted for RF coupling structure 200 in FIG. 2, other numbers of cavity vias may be utilized for each coupling structure in other embodiments. In one example, cavity vias 212 may, in conjunction with the bottom and middle metal layers, form a cavity (e.g., separate from the upper cavity) that confines the energy associated with this particular coupling structure without leaking the power to other adjacent coupling structures and/or associated radiating elements. Moreover, the cavity may serve as a circular short-matching stub to control the coupling efficiency and/or resonance frequency of the coupling structure.

Figure 3:
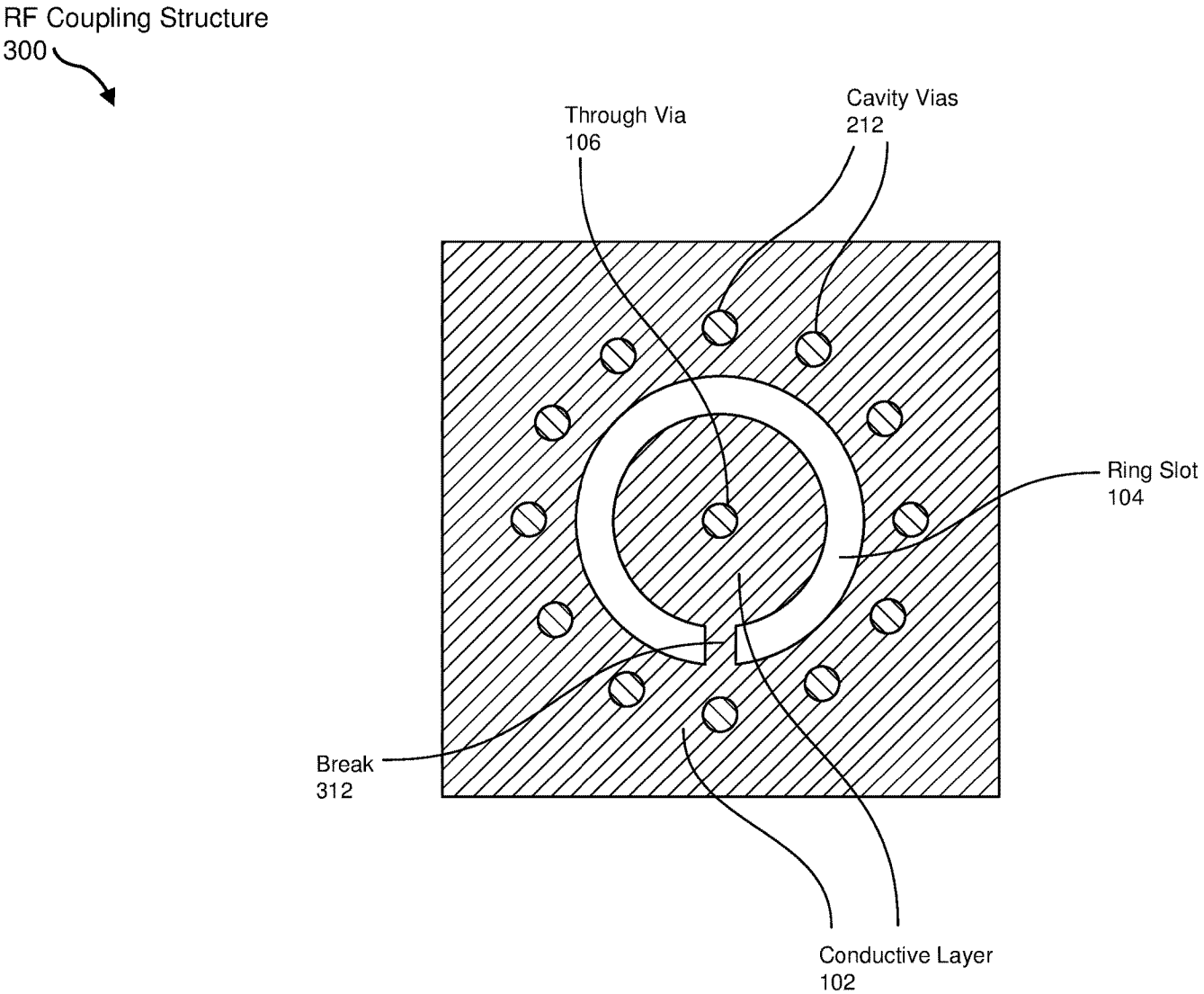
FIG. 3 is an illustration of an additional exemplary RF coupling structure that facilitates transferring RF signals between a waveguide and a radiating element in an antenna in accordance with one or more embodiments of this disclosure.

FIG. 3 illustrates a top-view cross section of an exemplary RF coupling structure 300 for coupling a waveguide to a radiating element of an antenna. As illustrated in FIG. 3, RF coupling structure 300 may include and/or represent various features described above in connection with FIGS. 1 and 2, including conductive layer 102, ring slot 104, through via 106, and cavity vias 212. In some examples, ring slot 104 may encompass and/or surround a majority of through via 106 in conductive layer 102. In such examples, ring slot 104 may include and/or incorporate a break 312 in which conductive material from conductive layer 102 remains intact. In other words, break 312 may constitute and/or represent conductive material that was not removed and/or impaired during the creation of ring slot 104. Accordingly, ring slot 104 may be split and/or bridged by conductive material in the bottom metal layer.

Figure 4:
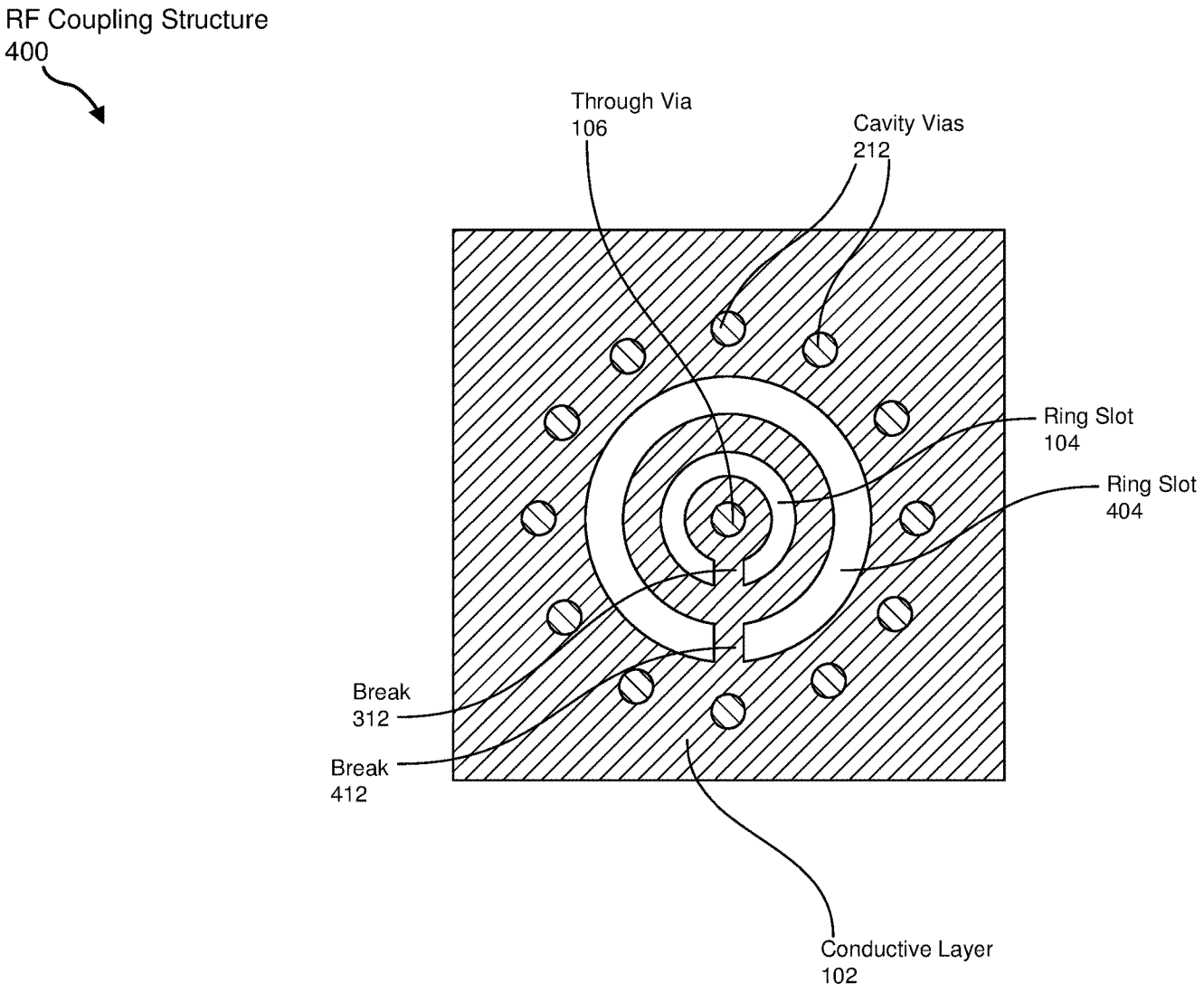
FIG. 4 is an illustration of an additional exemplary RF coupling structure that facilitates transferring RF signals between a waveguide and a radiating element in an antenna in accordance with one or more embodiments of this disclosure.

FIG. 4 illustrates a top-view cross section of an exemplary RF coupling structure 400 for coupling a waveguide to a radiating element of an antenna. As illustrated in FIG. 4, RF coupling structure 400 may include and/or represent various features described above in connection with FIGS. 1-3, including conductive layer 102, ring slot 104, through via 106, and cavity vias 212. In some examples, ring slot 104 may encompass and/or surround a majority of through via 106 in conductive layer 102. In such examples, ring slot 104 may include and/or incorporate break 312 in which conductive material from conductive layer 102 remains intact.

As illustrated in FIG. 4, RF coupling structure 400 may also include and/or represent an additional ring slot 404 formed around through via 106 and ring slot 104 in conductive layer 102. In some examples, ring slot 404 may be formed, cut, etched, and/or milled around through via 106 in conductive layer 102 to expose substrate 124 to waveguide 116. In such examples, at least a portion of conductive layer 102 may be removed, etched, and/or milled away to form ring slot 404 and/or expose substrate 124 to waveguide 116. In one embodiment, ring slot 404 may encompass and/or surround a majority of through via 106 in conductive layer 102 and/or a majority of ring slot 104. In this embodiment, ring slot 404 may include and/or incorporate a break 412 in which conductive material from conductive layer 102 remains intact. In other words, break 412 may constitute and/or represent conductive material that was not removed and/or impaired during the creation of ring slot 404. Accordingly, ring slot 404 may be split and/or bridged by conductive material in the bottom metal layer.

In some examples, ring slot 104 and 404 may be oriented, arranged, and/or configured such that breaks 312 and 412 of ring slots 104 and 404, respectively, face the same direction as one another and/or are aligned relative to through via 106. For example, ring slot 104 in FIG. 4 may be oriented so that break 312 in FIG. 4 faces downward relative to through via 106 in FIG. 4. Similarly, ring slot 404 in FIG. 4 may be oriented so that break 412 in FIG. 4 also faces downward relative to through via 106 in FIG. 4.

Figure 5:
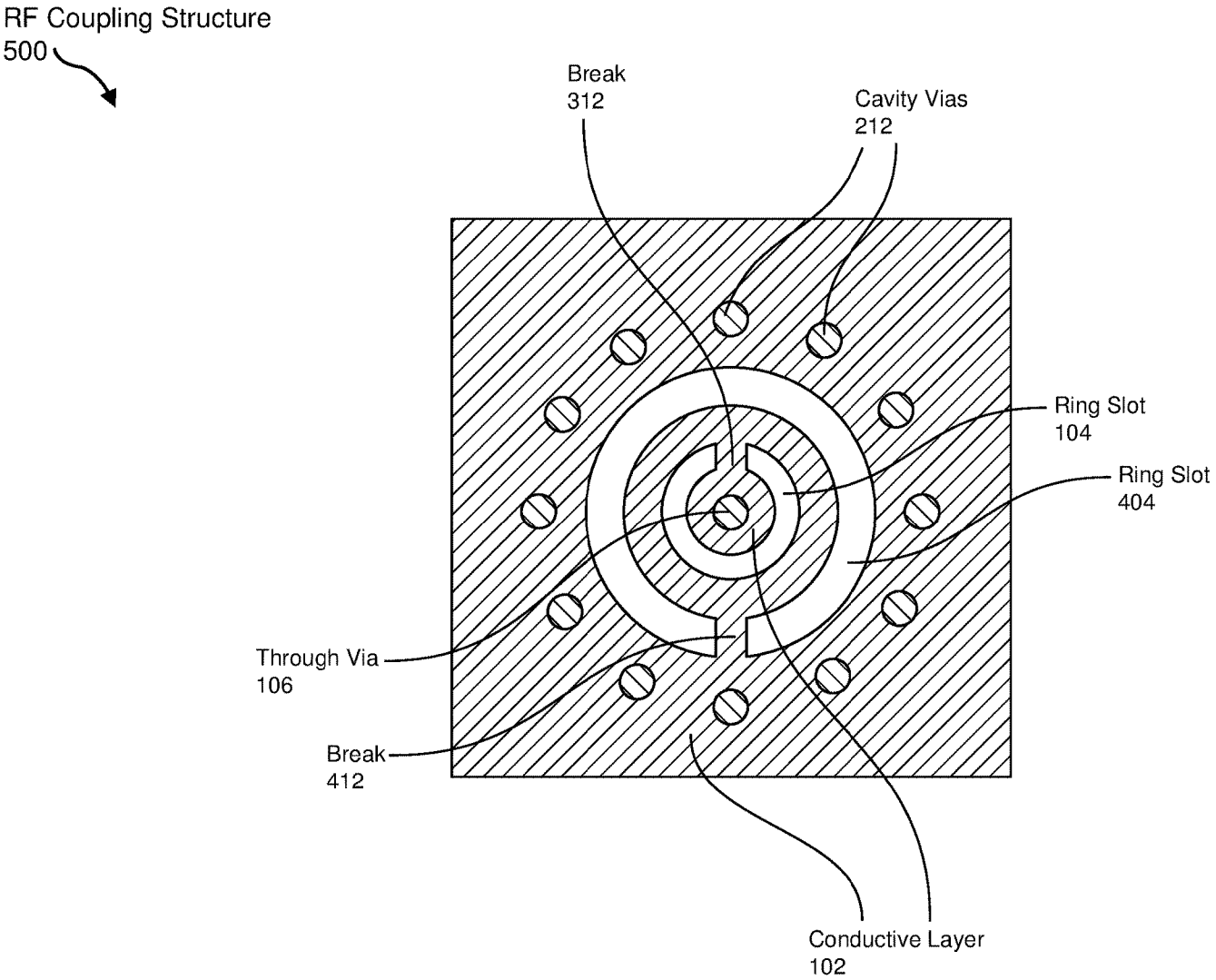
FIG. 5 is an illustration of an additional exemplary RF coupling structure that facilitates transferring RF signals between a waveguide and a radiating element in an antenna in accordance with one or more embodiments of this disclosure.

FIG. 5 illustrates a top-view cross section of an exemplary RF coupling structure 500 for coupling a waveguide to a radiating element of an antenna. As illustrated in FIG. 5, RF coupling structure 500 may include and/or represent various features described above in connection with FIGS. 1-4, including conductive layer 102, ring slot 104, through via 106, and cavity vias 212. In some examples, ring slot 104 may encompass and/or surround a majority of through via 106 in conductive layer 102. In such examples, ring slot 104 may include and/or incorporate break 312 in which conductive material from conductive layer 102 remains intact.

As illustrated in FIG. 5, RF coupling structure 500 may also include and/or represent an additional ring slot 404 formed around through via 106 and ring slot 104 in conductive layer 102. In some examples, ring slot 404 may encompass and/or surround a majority of through via 106 in conductive layer 102 and/or a majority of ring slot 104. In such examples, ring slot 404 may include and/or incorporate break 412 in which conductive material from conductive layer 102 remains intact.

In some examples, ring slot 104 and 404 may be oriented, arranged, and/or configured such that breaks 312 and 412 of ring slots 104 and 404, respectively, face different directions (e.g., opposite directions) and/or are aligned on opposing sides of through via 106. For example, ring slot 104 in FIG. 5 may be oriented so that break 312 in FIG. 5 faces upward relative to through via 106 in FIG. 5. Similarly, ring slot 404 in FIG. 5 may be oriented so that break 412 in FIG. 5 faces downward relative to through via 106 in FIG. 5.

Figure 6:
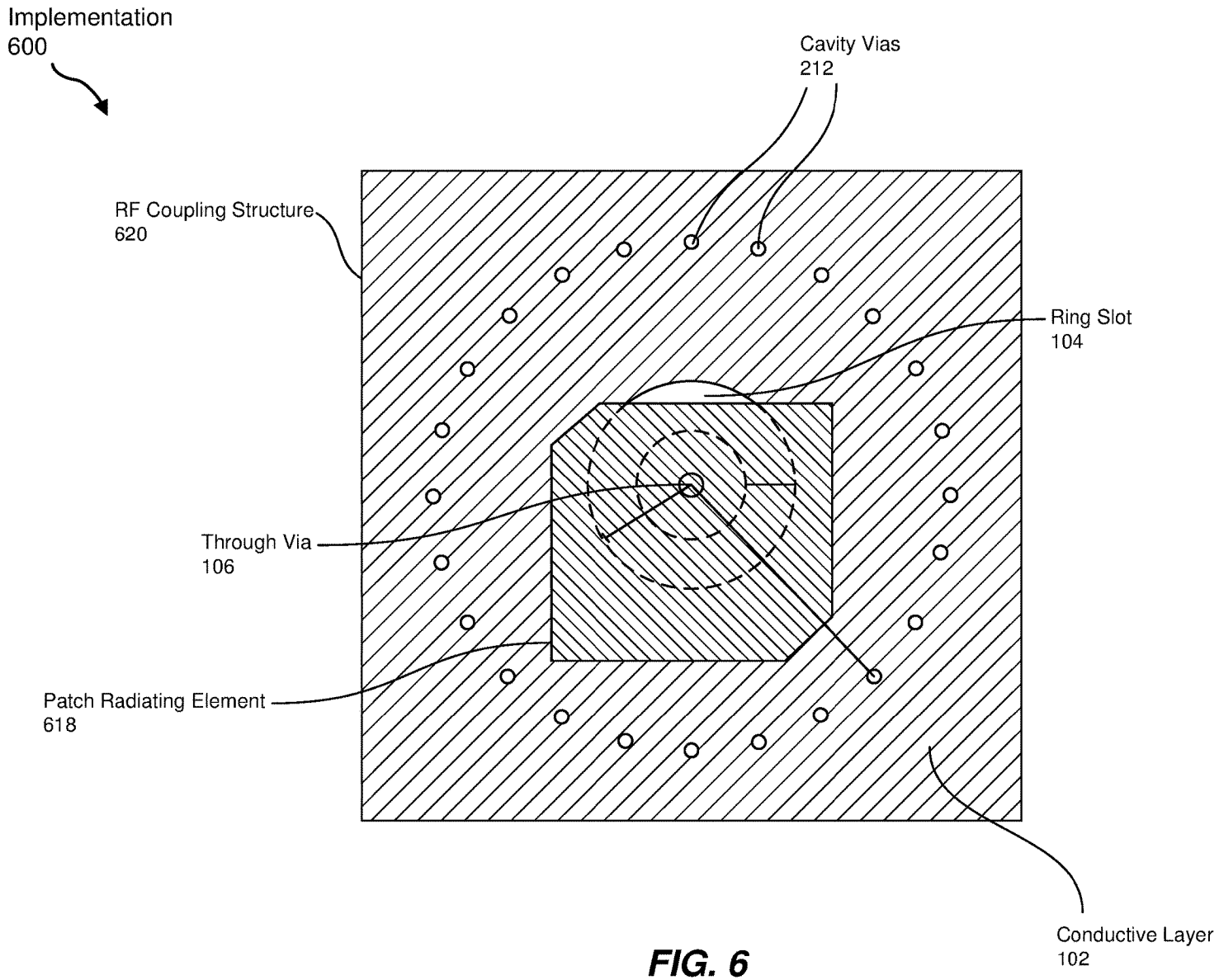
FIG. 6 is an illustration of an exemplary implementation of an RF coupling structure that facilitates transferring RF signals between a waveguide and a radiating element in accordance with one or more embodiments of this disclosure.

FIG. 6 illustrates a top view of an exemplary implementation 600 of an RF coupling structure 620 that facilitates coupling and/or transferring an RF signal propagating between a waveguide to a patch radiating element 618. As illustrated in FIG. 6, patch radiating element 618 may appear as a truncated square with chamfered opposing corners and/or may be positioned off-center when connected to a top end of through via 106. Although illustrated as a truncated square with chamfered corners in FIG. 6, patch radiating element 618 may alternatively take any number of other shapes (e.g., non-truncated squares, rectangles, circles, single-arm counterclockwise spiral element, multiple-arm spiral elements, and so on) in other embodiments.

The frequency and/or bandwidth of the RF resonance, as well as the coupling efficiency, provided by both continuous and split annular ring slot coupling structures may be altered by way of adjusting one or more physical parameters of the coupling structures. Examples of such parameters include, without limitation, the width of ring slot 104, the outer radius of ring slot from through via 106, the radius to the center of cavity vias 212 from through via 106, combinations or variations of one or more of the same, and/or any other suitable parameters.

Figure 7:
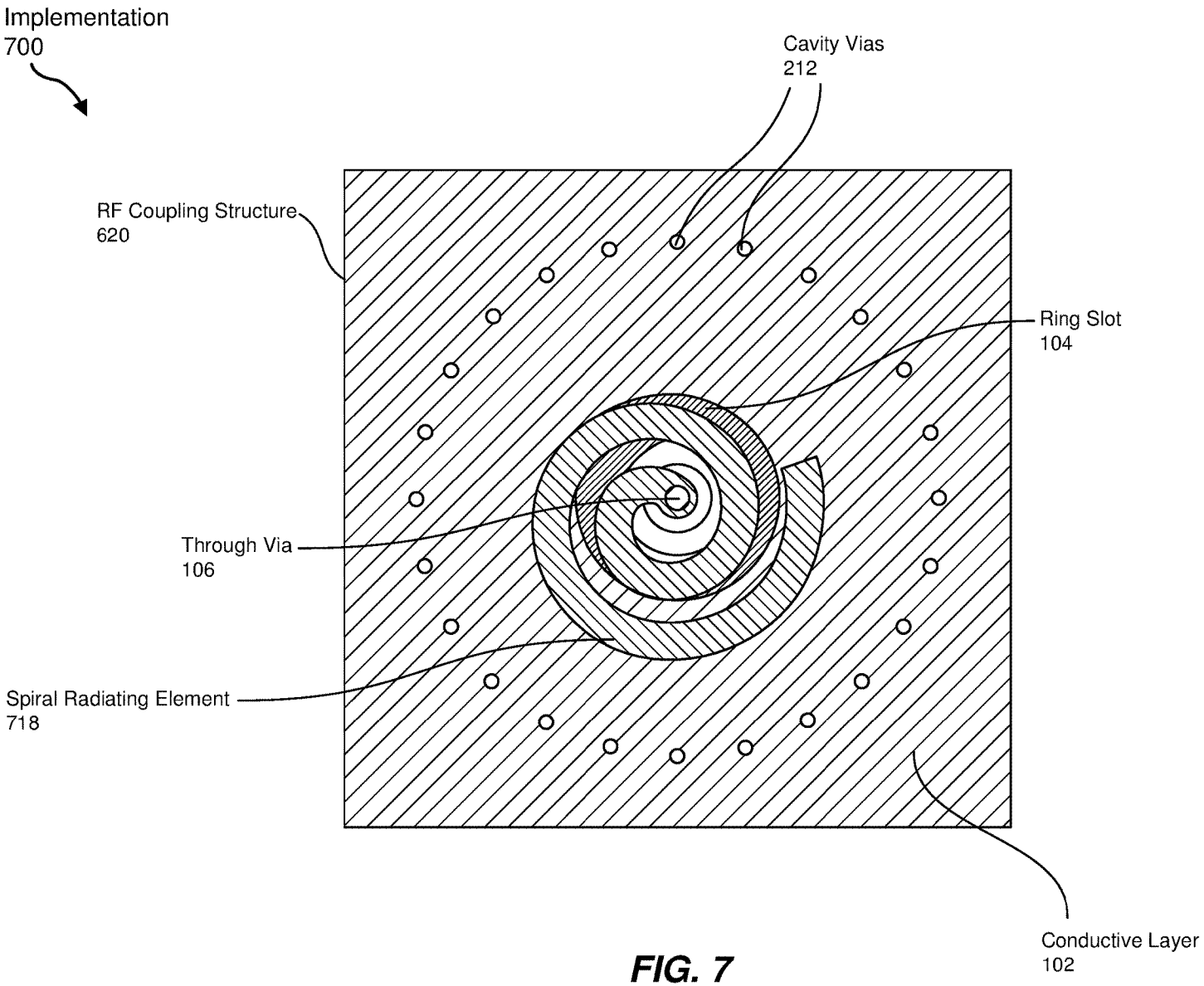
FIG. 7 is an illustration of an additional exemplary implementation of an RF coupling structure that facilitates transferring RF signals between a waveguide and a radiating element in accordance with one or more embodiments of this disclosure.

FIG. 7 illustrates a top view of an exemplary implementation 700 of RF coupling structure 620 that facilitates coupling and/or transferring an RF signal propagating between a waveguide to a spiral radiating element 718. As illustrated in FIG. 7, spiral radiating element 718 may appear as a single-arm spiral with right hand circular polarization. Although illustrated as a single-arm spiral with right hand circular polarization in FIG. 7, spiral radiating element 718 may alternatively take any number of other shapes (e.g., non-truncated squares, rectangles, circles, single-arm spiral with left hand circular polarization, multiple-arm spiral elements, and so on) in other embodiments.

Figure 8:
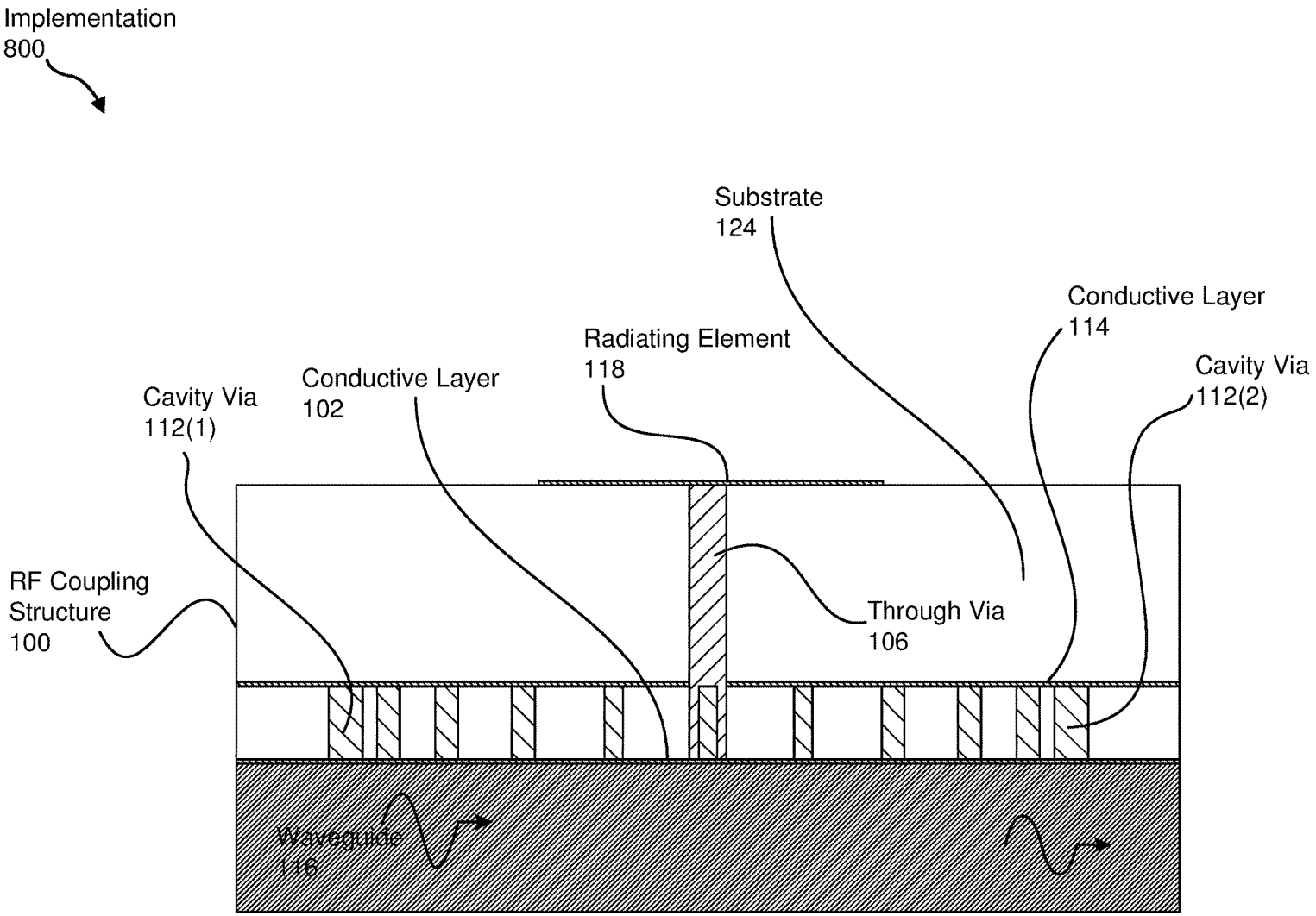
FIG. 8 is an illustration of an additional exemplary implementation of an RF coupling structure that facilitates transferring RF signals between a waveguide and a radiating element in accordance with one or more embodiments of this disclosure.

FIG. 8 illustrates a side-view cross section of an exemplary implementation 800 of RF coupling structure 100 for coupling waveguide 116 to radiating element 118 of an antenna. In some examples, RF coupling structure 100 may enable RF signals to traverse and/or travel from waveguide 116 to radiating element 118 for transmission from the antenna. Additionally or alternatively, RF coupling structure 100 may enable RF signals to traverse and/or travel from radiating element 118 to waveguide 116 for reception at the antenna.

As illustrated in FIG. 8, RF coupling structure 100 may include and/or represent a substrate 124 that forms, defines, and/or establishes a top side of waveguide 116 in conjunction with conductive layer 102. In some examples, RF coupling structure 100 may also include and/or represent conductive layer 114 disposed, embedded, and/or incorporated within and/or inside substrate 124. In one example, RF coupling structure 100 may further include and/or represent through via 106 that is communicatively and/or conductively coupled between conductive layer 102 and radiating element 118. In this example, through via 106 may extend, continue, and/or pass through an opening in conductive layer 114 to facilitate connecting conductive layer 102 to radiating element 118.

Figure 9:
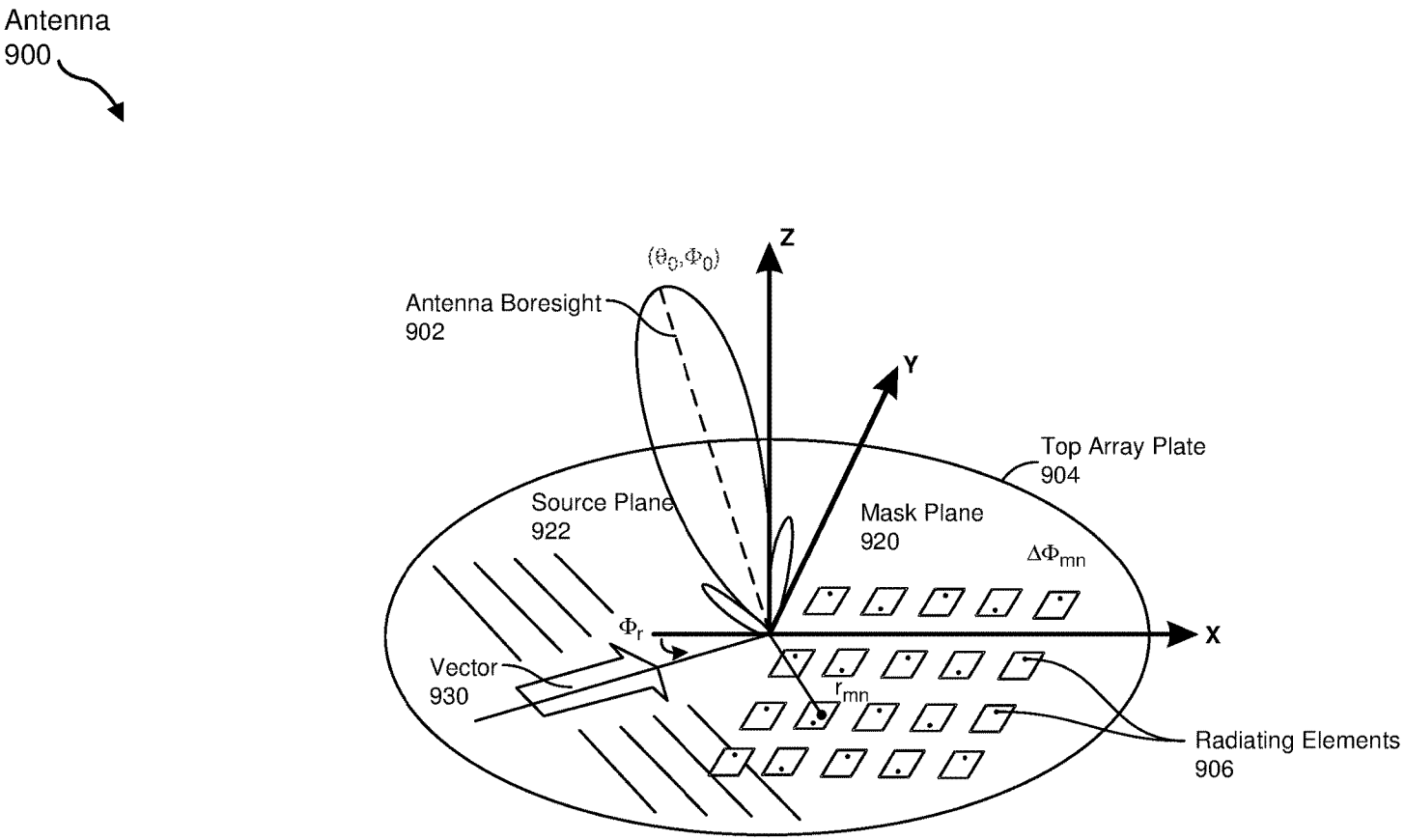
FIG. 9 is an illustration of an antenna that includes various RF coupling structures that facilitate transferring RF signals between a waveguide and various radiating elements in accordance with one or more embodiments of this disclosure.
Figure 10:
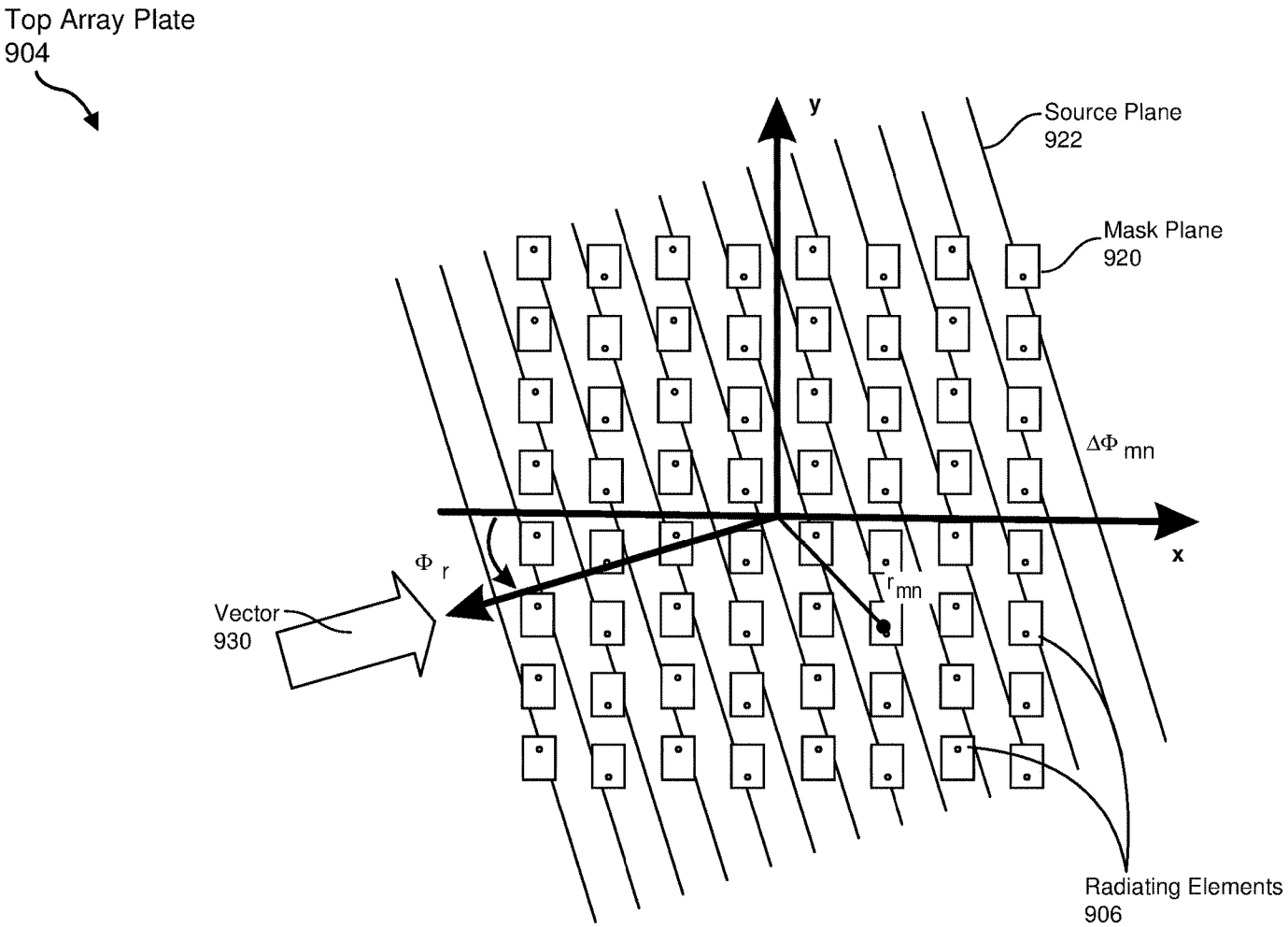
FIG. 10 is an illustration of a top array plate that includes various RF coupling structures that facilitate transferring RF signals between a waveguide and various radiating elements in accordance with one or more embodiments of this disclosure.

FIG. 9 illustrates a perspective view of an exemplary antenna 900 that includes a top array plate 904, and FIG. 10 illustrates a top view of top array plate 904. As illustrated in FIGS. 9 and 10, top array plate 904 may include and/or represent an array of radiating elements 906 (e.g., patch elements) in a transmission operating mode. In some examples, the (x, y, z) coordinate system shown in FIG. 9 may be defined by top array plate 904 with the rows and columns of the element array aligned with the x-y plane, which is labeled and/or referred to as a mask plane 920. In such examples, each radiating element in the array may correspond and/or coincide with a particular radius $r_{mn}$ and angle $\Delta\phi_{mn}$ relative to the x-y plane. In one example, a transmission electromagnetic mode (TEM) signal may propagate within waveguide 116 along a vector 930, thus defining a source plane 922.

In one example, source plane 922 may be rotated by an angle of $\phi_r$ relative to mask plane 922 corresponding to vector 930. In this example, radiating elements 906 may be excited by the TEM signal and/or may serve to amplify the TEM signal at their locations. The alignment of radiating elements 906 relative to the TEM signal may determine and/or define the orientation of an antenna boresight 902. In other words, the relative angle $\phi_r$ between mask plane 920 and source plane 922 may determine and/or define the elevation angle $\Theta_0$ and/or the azimuth angle $\phi_0$ of antenna boresight 902 relative to mask plane 920.

In operating antenna 900 to receive an RF signal (e.g., from a satellite aligned with antenna boresight 902), the excitation of radiating elements 906 in response to the received signal may cause an RF signal (e.g., a TEM signal) to propagate within the upper cavity. In some examples, the array elements excited by the received RF signal (e.g., receiving elements) may be different from the array elements responsible for transmitting an RF signal to the satellite (e.g. transmitting elements). Further, in some embodiments, the receiving elements and the transmitting elements may be interspersed such that they occupy the same antenna aperture, as defined by top array plate 904.

Further, the RF signal propagating within upper waveguide 204 may be coupled into a lower waveguide of antenna 900 by one or more RF coupling structures of bottom RF guide plate 130, resulting in an RF signal (e.g., a TEM signal) propagating in the lower waveguide. In one example, this RF signal may be sensed by an RF board via an RF feed and/or launch structure. In this example, the RF board may demodulate and convert the sensed signal into an intermediate frequency (IF) signal that is processed further via a data interface board.

FIG. 11 illustrates a side cross-section of an exemplary low-profile steerable antenna 1100 that incorporates and/or employs an RF board 320 for transmitting and/or receiving RF signals in connection with a lower waveguide 202 and an upper waveguide 204. In some examples, exemplary low-profile steerable antenna 1100 may facilitate and/or support exchanging communications with remote antennas via a constellation of satellites. As illustrated in FIG. 11, exemplary steerable antenna 1100 may each include and/or represent a stationary base 302, an azimuth motor 304, an elevation motor 306, a bottom RF guide plate 130, and a top array plate 1104. In some examples, azimuth motor 304 may be fixably coupled and/or attached to stationary base 302, and elevation motor 306 may also be fixably coupled and/or attached to stationary base 302. Additionally or alternatively, bottom RF guide plate 130 may be rotatably coupled to stationary base 302 via a shaft 328, and top array plate 1104 may be rotatably coupled to stationary base 302 via a shaft 326.

In some examples, azimuth motor 304 may control and/or direct the rotation and/or orientation of shaft 328 and/or bottom RF guide plate 130. For example, azimuth motor 304 may move and/or rotate bottom RF guide plate 130 about or around shaft 328. In this example, shaft 328 may establish and/or provide a fixed axis for rotational movement of bottom RF guide plate 130.

Additionally or alternatively, elevation motor 306 may control and/or direct the rotation and/or orientation of shaft 326 and/or top array plate 1104. For example, elevation motor 306 may move and/or rotate top array plate 1104 about or around shaft 326. In this example, shaft 326 may establish and/or provide a fixed axis for rotational movement of top array plate 1104.

In some examples, top array plate 1104 and bottom RF guide plate 130 may collectively form, establish, and/or create upper waveguide 204, which is configured to direct RF signals in a specific direction. In one example, with reference to FIG. 11, RF board 320 may launch an RF signal into lower waveguide 202 of bottom RF guide plate 130. In this example, the RF signal may traverse and/or travel from RF board 320 to the left in FIG. 11 toward RF coupling structures 340. The RF signal may pass from lower waveguide 202 through RF coupling structures 340 to upper waveguide 204. Upon reaching upper waveguide 204, the RF signal may traverse and/or travel within upper waveguide 204 in the opposite direction back toward shaft 326.

As illustrated in FIG. 11, azimuth motor 304 may interface directly with shaft 328 via a coupling mechanism 332, and elevation motor 306 may interface directly with shaft 326 via a coupling mechanism 334. In one example, coupling mechanism 332 may include and/or represent a gear, pulley, or belt system that enables azimuth motor 304 to control and/or rotate shaft 328. By doing so, azimuth motor 304 may be able to control and/or rotate bottom RF guide plate 130 to a specific orientation and/or position. Similarly, coupling mechanism 334 may include and/or represent a gear, pulley, or belt system that enables elevation motor 306 to control and/or rotate shaft 326. By doing so, elevation motor 306 may be able to control and/or rotate top array plate 1104 to a specific orientation and/or position.

In some examples, shaft 328 may be hollow and/or form a hole or passage designed to accommodate shaft 326. For example, shaft 326 may rotatably couple top array plate 1104 to stationary base 302 by passing though the hollow region, hole, and/or passage of shaft 328. In this example, shaft 328 may rotatably couple bottom RF guide plate 130 to stationary base 302 despite shaft 326 being located and/or positioned inside the hollow region, hole, and/or passage of shaft 328.

In some examples, shaft 326 and/or shaft 328 may be co-centered with respect to the MSA, stationary base 302, top array plate 1104, and/or bottom RF guide plate 130. In one example, shaft 326 and/or shaft 328 may provide, facilitate, and/or support low-friction spinning and/or rotation of top array plate 1104 and/or bottom RF guide plate 130 around a fixed axis. Additionally or alternatively, shaft 326 and/or shaft 328 may provide, facilitate, and/or support a low moment of inertia for top array plate 1104 and/or bottom RF guide plate 130. Such features may enable the MSA to achieve high-speed handover from one satellite to another satellite.

In some examples, stationary base 302 may include and/or represent any type or form of structure, housing, and/or footing capable of supporting top array plate 1104 and/or bottom RF guide plate 130. Accordingly, stationary base 302 may maintain and/or secure shafts 326 and 328 about which top array plate 1104 and bottom RF guide plate 130, respectively, rotate.

Stationary base 302 may be of various shapes and/or dimensions. In some examples, base 302 may be circular and/or cylindrical. Additional examples of shapes formed by base 302 include, without limitation, ovoids, cubes, cuboids, spheres, spheroids, cones, prisms, variations or combinations of one or more of the same, and/or any other suitable shapes.

Stationary base 302 may be sized in a particular way to house and/or stabilize rotating co-axial plates and/or disks.

Stationary base 302 may include and/or contain any of a variety of materials. Examples of such materials include, without limitation, metals, plastics, ceramics, polymers, composites, rubbers, variations or combinations of one or more of the same, and/or any other suitable materials.

In some examples, azimuth motor 304 and/or elevation motor 306 may each include and/or represent any type or form of motor capable of controlling and/or rotating top array plate 1104 and/or bottom RF guide plate 130, respectively. In one example, azimuth motor 304 and/or elevation motor 306 may each include and/or represent a stepper motor. Additional examples of azimuth motor 304 and/or elevation motor 306 include, without limitation, servomotors, direct current (DC) motors, alternating current (AC) motors, variations or combinations of one or more of the same, and/or any other suitable motors.

Azimuth motor 304 and/or elevation motor 306 may be of various shapes and/or dimensions. In one example, azimuth motor 304 and/or elevation motor 306 may each be shaped as a cylinder. In another example, azimuth motor 304 and/or elevation motor 306 may each be shaped as a cube or cuboid.

Azimuth motor 304 and/or elevation motor 306 may be sized in a particular way to fit within an MSA. Azimuth motor 304 and/or elevation motor 306 may include and/or contain any of a variety of materials. Examples of such materials include, without limitation, metals, plastics, ceramics, polymers, composites, rubbers, variations or combinations of one or more of the same, and/or any other suitable materials.

In some examples, top array plate 1104 and/or bottom RF guide plate 130 may each include and/or represent any type of form of plate and/or disk capable of transmitting and/or receiving RF communications. Top array plate 1104 and/or bottom RF guide plate 130 may each be of various shapes and/or dimensions. In one example, top array plate 1104 and/or bottom RF guide plate 130 may each be shaped as a disk and/or circle. Additional examples of shapes formed by top array plate 1104 and/or bottom RF guide plate 130 include, without limitation, squares, rectangles, triangles, pentagons, hexagons, octagons, ovals, diamonds, parallelograms, variations or combinations of one or more of the same, and/or any other suitable shapes.

Top array plate 1104 and/or bottom RF guide plate 130 may be sized in a particular way to fit within an MSA. Top array plate 1104 and/or bottom RF guide plate 130 may include and/or contain any of a variety of materials. Examples of such materials include, without limitation, metals, coppers, aluminums, steels, stainless steels, silver, variations or combinations of one or more of the same, and/or any other suitable materials.

In some examples, exemplary antenna 1100 may include and/or incorporate bearing 324(1) and/or bearing 324(2) applied between shaft 326 and shaft 328. In one example, bearings 324(1) and 324(2) may provide, facilitate, and/or support free rotational movement for top array plate 1104 and/or bottom RF guide plate 130 around a fixed axis. In this example, bearings 324(1) and 324(2) may be attached and/or fitted around the exterior of shaft 326. Additionally or alternatively, bearings 324(1) and 324(2) may be attached and/or fitted inside the hollow region, hole, and/or passage of shaft 328.

Additionally or alternatively, exemplary antenna 1100 may include and/or incorporate bearing 322(1) and/or bearing 322(2) applied between shaft 328 and stationary base 302. In one example, bearings 322(1) and 322(2) may provide, facilitate, and/or support free rotational movement for bottom RF guide plate 130 around a fixed axis. In this example, bearings 322(1) and 322(2) may be attached and/or fitted around the exterior of shaft 328. Additionally or alternatively, bearings 322(1) and 322(2) may be attached and/or fitted inside a flange, ridge, and/or lip of stationary base 302. Examples of bearings 324(1), 324(2), 322(1), and 322(2) include, without limitation, ball bearings, roller bearings, plain bearings, jewel bearings, fluid bearings, magnetic bearings, flexure bearings, variations or combinations of one or more of the same, and/or any other suitable type of bearings.

In some examples, bearings 324(1) and 324(2) may maintain and/or support top array plate 1104 and/or bottom RF guide plate 130 in a certain position relative to one another within the MSA. In such examples, bearings 324(1) and 324(2) may rotate top array plate 1104 and/or bottom RF guide plate 130 relative to stationary base 302. Additionally or alternatively, bearings 322(1) and 322(2) may maintain and/or support bottom RF guide plate 130 in a certain position relative to stationary base 302. In these examples, bearings 322(1) and 322(2) may rotate bottom RF guide plate 130 relative to stationary base 302.

In some examples, exemplary steerable antenna 1100 may include and/or incorporate RF board 320 coupled and/or attached to bottom RF guide plate 130. In one example, RF board 320 may generate and/or produce an RF signal for transmission to an overhead satellite. In this example, bottom RF guide plate 130 may form and/or incorporate a waveguide that directs the RF signal toward one or more slots and/or other RF coupling structures that facilitate and/or support the transmission to the overhead satellite. As illustrated in FIG. 11, exemplary steerable antenna 1100 may provide a lower waveguide 202 that directs an RF signal generated by RF board 320 toward RF coupling structures 340, which facilitate and/or support the transmission of the RF signal.

In some examples, exemplary steerable antenna 1100 may include and/or incorporate a data interface board 316 coupled and/or attached to stationary base 302. In one example, data interface board 316 may feed and/or source intermediate frequency data to RF board 320 via an umbilical cable 330. In this example, RF board 320 may then convert and/or integrate intermediate frequency data into the RF signal transmitted to the overhead satellite.

In some examples, data interface board 316 and/or RF board 320 may include and/or contain one or more processing devices and/or memory devices. Such processing devices may each include and/or represent any type or form of hardware-implemented processing device capable of interpreting and/or executing computer-readable instructions. In one example, such processing devices may access and/or modify certain software modules, applications, and/or data stored in the memory devices. Examples of such processing devices include, without limitation, physical processors, central processing units (CPUs), microprocessors, microcontrollers, Field-Programmable Gate Arrays (FPGAs) that implement softcore processors, Application-Specific Integrated Circuits (ASICs), Systems on a Chip (SoCs), portions of one or more of the same, variations or combinations of one or more of the same, and/or any other suitable processing devices.

Such memory devices may each include and/or represent any type or form of volatile or non-volatile storage device or medium capable of storing data, computer-readable instructions, software modules, applications, and/or operating systems. Examples of such memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, and/or any other suitable storage memory devices. In some examples, certain processing devices and memory devices may be considered and/or viewed as a single device and/or unit.

In some examples, data interface board 316 may provide intermediate frequency data by way of an umbilical cable to RF board 320, which modulates an RF reference wave to generate the RF signals that are subsequently fed to the lower cavity and/or lower waveguide 202 by an RF feed structure (e.g., pins, slots, and/or other RF coupling structures). In some examples, the RF feed structure and/or board may be fixably coupled to an outer surface (e.g., an underside) of the bottom RF guide plate. Some embodiments of the feed or launch structure are described in greater detail below in connection with FIGS. 2 and 3.

In some examples, top array plate 1104 may include and/or incorporate choke structures 136(1) and 136(2) that, together with bottom RF guide plate 130, form RF chokes 346(1) and 346(2), respectively. For example, choke structures 136(1) and 136(2) may be coupled to top array plate 1104 such that these choke structures and bottom RF guide plate 130 collectively produce RF chokes 346(1) and 346(2). In this example, RF chokes 346(1) and 346(2) may prevent and/or mitigate RF energy leakage or intrusion between upper waveguide 204 and the area outside upper waveguide 204.

In some examples, choke structures 136(1) and 136(2) may each include and/or represent any type or form of structure and/or feature that, in conjunction with bottom RF guide plate 130, is capable of rejecting and/or blocking RF signals. Choke structures 136(1) and 136(2) may take any of various forms, shapes, designs, and/or dimensions. In one example, one or more of choke structures 136(1) and 136(2) may include and/or constitute an L-shaped choke structure. In another example, one or more of choke structures 136(1) and 136(2) may include and/or constitute a T-shaped choke structure. In a further example, one or more of choke structures 136(1) and 136(2) may include and/or constitute a plus-shaped and/or cross-shaped choke structure. In an additional example, one or more of choke structures 136(1) and 136(2) may include and/or constitute a stacked T-shaped choke structure. In an alternative example, one or more of choke structures 136(1) and 136(2) may include and/or constitute an F-shaped choke structure.

Further regarding antenna 1100 in FIG. 11, choke structures 136(1) and 136(2) may be employed at a gap between the PCB array holding clamp (e.g., a clamp that retains the top array plate) and the bottom RF guide plate. In some embodiments, the gap may be provided to facilitate relative rotation between the top array plate and the bottom RF guide plate to facilitate changes in the azimuth and elevation angles of the antenna boresight. In one embodiment, this gap (e.g., in isolation or with other structures) may be shaped as a branched RF choke structure to provide isolation and/or prevent RF energy leakage between the upper cavity and areas outside the upper cavity via the gap.

In some examples, choke structures 136(1) and 136(2) may be dimensioned for isolation performance over at least some portion of the $K_u$ band (e.g., from approximately 10.70 gigahertz (GHz) to about 14.50 GHz, which may be employed in antenna 1100 in FIG. 11 to transmit and/or receive RF signals). However, other examples may employ different physical dimensions for choke structures 136(1) and 136(2) to provide isolation over different RF bands.

In some examples, the term "branched" may generally refer to a choke structure that changes directions transverse to a direction of propagation of RF energy within a waveguide to which the choke structure is coupled. In one example, a rectangular waveguide may be applied with opposing RF choke structures at each end. However, each choke structure may also be implemented with other waveguides, such as the upper cavity of antenna 1100 in FIG. 11.

In some examples, choke structures 136(1) and 136(2) may provide isolation (e.g., an RF "open circuit") at diametrically opposing sides of bottom RF guide plate 130 at the gap between the PCB array holding clamp (e.g., that retains top array plate 1104) and bottom RF guide plate 130—with the rectangular waveguide modeling a portion of the upper cavity extending between the RF choke structures and passing through the center of the upper cavity. Consequently, in some embodiments, the opposing RF choke structures may represent much wider nonlinear structures formed along opposing sides of circular bottom RF guide plate 130 and top array plate 1104. In some examples, the use of choke structures in such an environment may result in a maximized amount of RF signal energy present between the choke structures and a minimized amount of RF signal energy present outside the choke structures (e.g., external to the upper cavity).

Choke structures 136(1) and 136(2) may each include and/or represent any of various materials. In one example, choke structures 136(1) and 136(2) may include and/or contain one or more metals (e.g., aluminums). Examples of such materials include, without limitation, coppers, golds, steels, alloys, silvers, nickels, brass, silicon, glasses, polymers, variations or combinations of one or more of the same, and/or any other suitable materials.

In some examples, choke structures 136(1) and 136(2) may each be of any suitable shape and/or dimensions. In one example, choke structures 136(1) and 136(2) may be sized in a particular way to prevent the escape and/or intrusion of RF signals via the opening between top array plate 1104 and/or bottom RF guide plate 130. For example, one dimension (e.g., a length) of choke structures 136(1) and 136(2) may be substantially equal to a quarter wavelength of the RF signals multiplied by an odd number (e.g., 1).

In some examples, top array plate 1104 and/or bottom RF guide plate 130 may be positioned and/or oriented in certain ways to steer, direct, and/or aim a boresight (e.g., the axis of maximum gain of the antenna) in different directions. These positions and/or orientations of top array plate 1104 and bottom RF guide plate 130 may be achieved for purposes of tracking an overhead satellite and/or switching between satellites.

In some examples, top array plate 1104 and/or bottom RF guide plate 130 may include and/or represent various antennae elements, features, and/or tiles combined and/or configured as a single unit. In one example, the single unit may constitute and/or represent a directional antenna system capable of beamforming and/or spatial filtering in connection with transmitting and/or receiving communications.

In some embodiments, the top array plate may be 350-to-450 millimeters (mm) in diameter, and the bottom RF guide plate may be 345-to-445 mm in diameter. However, other sizes for the top array plate and the bottom RF guide plate may also be employed. In one example, a total height for the antenna, including the stationary base, may be approximately 100-to-120 mm, resulting in a low-profile antenna arrangement.

While the component of the steerable antenna to which the bottom RF guide plate and the top array plate are coupled is termed a "stationary base", such a base may be fixably coupled to the ground or to a movable platform (e.g., an airborne or ground-based vehicle). In either case, the stationary base may provide a reference frame within which the bottom RF guide plate and the top array plate may be oriented to provide connectivity to a satellite.

In some examples, the bottom RF guide plate and the top array plate may form RF cavities or waveguides that facilitate the transmission and/or reception of RF signals. More specifically, in some examples, the bottom RF guide plate may define and/or form a lower cavity. In addition, the lower cavity may connect to and/or be equipped with one or more openings or other features that form part of a feed and/or launch structure for introducing an RF signal into the lower cavity for transmission to a satellite by the antenna and/or for receiving an RF signal from a satellite by the antenna via the lower cavity. While one RF feed is depicted in FIG. 11, multiple RF feeds and associated circuitry may be employed in other embodiments.

In some examples, one or more coupling structures (e.g., one or more slots in the bottom RF guide plate, possibly in combination with other components and/or materials, such as metal patches, dielectric materials, and/or the like) may couple the lower cavity with an upper cavity defined by the combination of the bottom RF guide plate and the top array plate. For example, RF coupling structures 340 may effectively couple lower waveguide 202 and upper waveguide 204 together such that RF signals launched by RF board 320 are able to traverse from lower waveguide 202 to upper waveguide 204 via RF coupling structures 340. Additionally or alternatively, RF coupling structures 340 may effectively couple lower waveguide 202 and upper waveguide 204 together such that RF signals received by antenna 1100 are able to traverse from upper waveguide 204 to lower waveguide 202 via RF coupling structures 340.

In some examples, the top array plate may include a holding clamp at a perimeter about the top array plate for holding a printed circuit board (PCB). In one example, the PCB may include and/or incorporate an array of antenna array elements (e.g., patch antenna elements, spiral antenna array elements, and/or the like) positioned for transmission and/or reception of RF signals between the antenna and the satellite. In this example, an edge region of the top array plate and the bottom RF guide plate may form a waveguide choke flange and associated slot (or other such RF coupling structures) that substantially restrict leakage of RF energy over an operating range of frequencies of the RF signals being transmitted and received by the antenna. The choke flange and/or slot may thus form a contactless interface between the top array plate and the bottom RF guide plate to facilitate relative changes in orientation between the two plates.

In operation, for transmitting RF signals from the antenna (e.g., to a satellite), an RF feed and/or launch structure may introduce the RF signal into the lower cavity for propagation within the lower cavity (e.g., as a transverse electric mode signal). In response to the coupling structures of the bottom RF guide plate, the RF signal in the lower cavity may traverse into the upper cavity (e.g., as a transverse electromagnetic mode signal). In some embodiments, the resulting RF signal may be directed along a particular direction determined by the orientation of the bottom RF guide plate based at least in part on the arrangement, location, and/or orientation of the coupling structures as well as the RF feed into the lower cavity. Moreover, the RF signal in the upper cavity may interact with the elements of the antenna array that facilitate transmitting the RF signal to the satellite. In at least one example, antenna 1100 may exhibit and/or control an elevation angle 352 of an antenna boresight 354 (the axis along which the RF signal is transmitted). In this example, elevation angle 352 of antenna boresight 354 may be determined by the alignment of the array elements relative to the direction along which the RF signal in the upper cavity is aligned.

In the embodiments described above, the orientation of the bottom RF guide plate (e.g., due to the positioning and/or alignment of the RF feed and/or the coupling structure) and the top array plate (e.g., due to the arrangement and/or structure of the element array) may determine and/or control the orientation (azimuth and elevation) of antenna boresight 354 along which the RF signal is transmitted. In some examples, the same change in the orientation of both the bottom RF guide plate and the top array plate may result in the same change in the azimuth angle of antenna boresight 354 without a change in the elevation angle of antenna boresight 354. In those examples, a change in the orientation of the top array plate without a change in orientation of the bottom RF guide plate may result in a change of the same amount of elevation of antenna boresight 354. Additionally, in some embodiments, such a change in orientation of the top array plate alone may result in a change in orientation of azimuth of the antenna boresight (e.g., by half the amount of the change in orientation of the elevation of the antenna boresight).

In operating the antenna to receive an RF signal (e.g., from the satellite aligned with the antenna boresight), excitation of elements of the antenna array in response to the received signal may cause an RF signal (e.g., a transverse electromagnetic mode signal) to propagate within the upper cavity. In some examples, the array elements being excited by the received RF signal (e.g., receiving elements) may be different from the array elements responsible for transmitting an RF signal to the satellite (e.g., transmitting elements). Further, in some embodiments, the receiving elements and the transmitting elements may be interspersed such that they occupy the same antenna aperture, as defined by the top array plate.

Further, the RF signal propagating within the upper cavity may be coupled into the lower cavity by the one or more coupling structures of the bottom RF guide plate, resulting in an RF signal (e.g., a transverse electric mode signal) propagating in the lower cavity, which may be sensed by the RF board via the RF feed, launch structure, and/or additional components. The RF board may demodulate and/or convert the sensed signal into an intermediate frequency signal that is processed further via data interface board 316.

While embodiments of the antenna, as described herein, generally presume their use for communication with low Earth orbit (LEO) satellites, communication with medium Earth orbit (MEO) satellites, communication with satellites in other orbits, and communication with other devices (e.g., aircraft) may also benefit from the various examples discussed herein.

In FIG. 11, RF board 320 may implement and/or employ a patch-fed structure for launching and/or receiving RF signals. For example, a patch structure of RF board 320 may launch an RF signal into lower waveguide 202 and/or receive an RF signal from lower waveguide 202. In particular, the lower cavity that serves as the waveguide may be substantially circular in one dimension and/or may possess a substantially constant height in another dimension. Also, while antenna 1100 in FIG. 11 depicts a single RF feed structure for launching the RF signal into the lower cavity, two or more such feed structures (e.g., two or more patch structures, as described below) may be employed in some embodiments of antenna 1100.

In some examples, lower waveguide 202 may include and/or contain a reflector designed to reflect and/or bounce RF signals back in the opposite direction. Additionally or alternatively, upper waveguide 204 may include and/or contain another reflector designed to reflect and/or bounce RF signals back in the opposite direction. For example, some RF signals traversing and/or travelling through lower waveguide 202 or upper waveguide 204 in the leftward direction in FIG. 11 may reach the reflector. In this example, such RF signals may be reflected and/or bounced back in the rightward direction in FIG. 11 by the reflector. In one embodiment, the reflector may be applied to an end of lower waveguide 202 and/or upper waveguide 204 positioned proximate to RF coupling structures 340.

In some examples, lower waveguide 202 may be configured and/or designed to direct certain RF signals in a specific direction, and upper waveguide 204 may be configured and/or designed to direct such RF signals in the opposite direction. For example, lower waveguide 202 may be configured and/or designed to direct RF signals being transmitted by antenna 1100 in the leftward direction in FIG. 11 toward RF coupling structures 340. In contrast, upper waveguide 204 may be configured and/or designed to direct such RF signals being transmitted by antenna 1100 in the rightward direction in FIG. 11 away from RF coupling structures 340.

Similarly, upper waveguide 204 may be configured and/or designed to direct RF signals received by antenna 1100 in the leftward direction in FIG. 11 toward RF coupling structures 340. In contrast, lower waveguide 202 may be configured and/or designed to direct such RF signals received by antenna 1100 in the rightward direction in FIG. 11 away from RF coupling structures 340.

In some examples, lower waveguide 202 and/or upper waveguide 204 may each include and/or represent any type or form of structure and/or feature capable of guiding and/or directing RF signals. In one example, lower waveguide 202 and/or upper waveguide 204 may each include and/or represent a hollow metallic pipe and/or disk that carries radio waves in one direction and/or another. In this example, lower waveguide 202 and/or upper waveguide 204 may each serve and/or function as a transmission line. Accordingly, lower waveguide 202 and/or upper waveguide 204 may each constitute a link in the transmission path of RF signals sent from and/or received by antenna 1100.

Lower waveguide 202 and/or upper waveguide 204 may each include and/or represent any of various materials. Examples of such materials include, without limitation, coppers, golds, steels, alloys, silvers, nickels, brass, aluminums, silicon, glasses, polymers, variations or combinations of one or more of the same, and/or any other suitable materials.

In some examples, lower waveguide 202 and/or upper waveguide 204 may each be of any suitable shape and/or dimensions. In one example, lower waveguide 202 and/or upper waveguide 204 may include and/or form a hollow cylinder and/or cuboid. Accordingly, lower waveguide 202 and/or upper waveguide 204 may maintain a cylindrical and/or rectangular shape that extends across certain parts of the corresponding antenna system. Additional examples of shapes formed by lower waveguide 202 and/or upper waveguide 204 include, without limitation, ovoids, cubes, cuboids, spheres, spheroids, cones, prisms, variations or combinations of one or more of the same, and/or any other suitable shapes.

Figure 12:
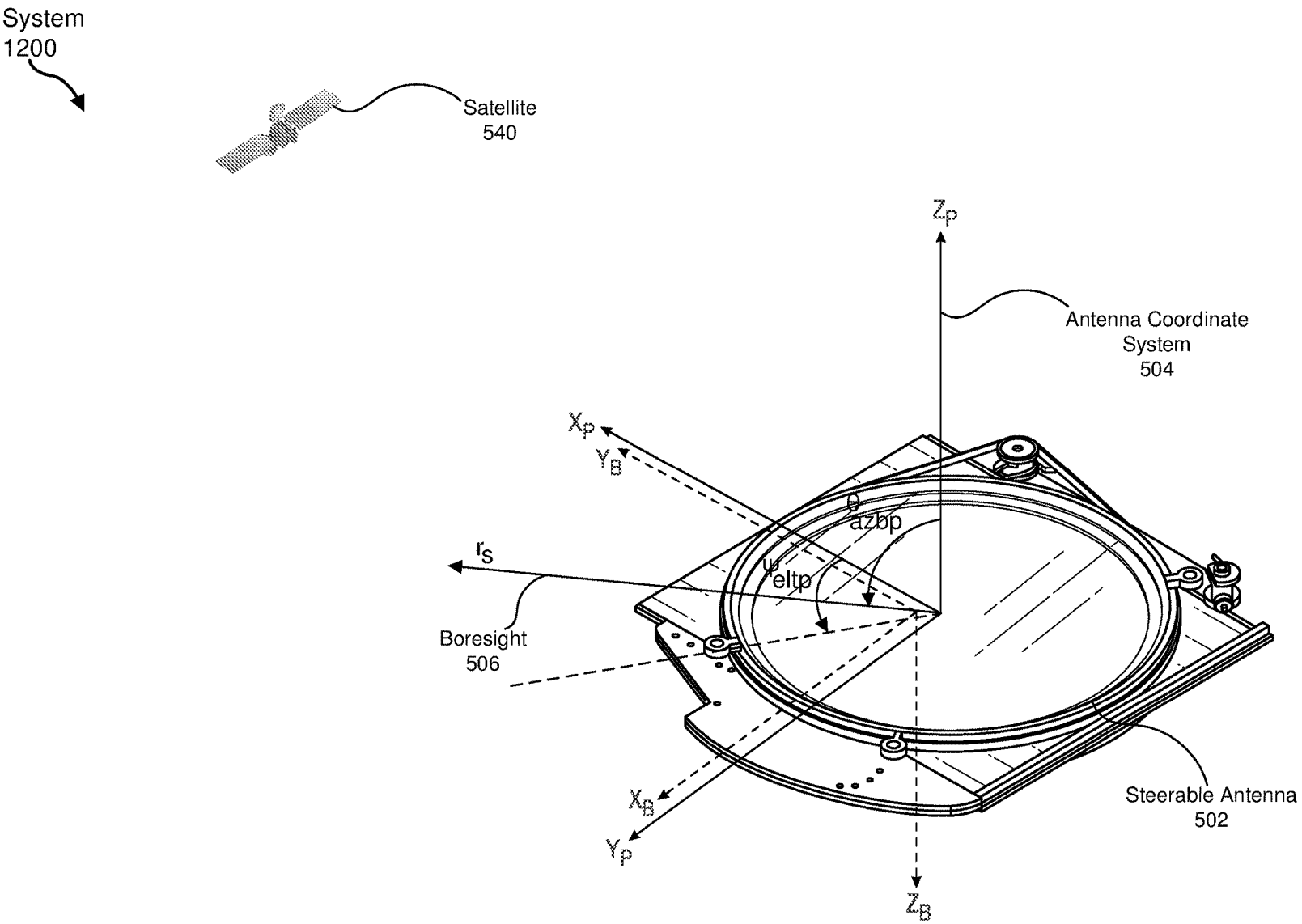
FIG. 12 is an illustration of an exemplary system that includes a steerable antenna and a satellite in communication with one another in accordance with one or more embodiments of this disclosure.

FIG. 12 is an illustration of an exemplary system 1200 in which a steerable antenna 502 tracks a satellite 540 passing overhead. In some examples, steerable antenna 502 may implement and/or incorporate any of the various components, features, and/or devices described above in connection with FIGS. 1-11. As illustrated in FIG. 12, steerable antenna 502 may steer, direct, and/or aim a boresight 506 in a certain direction in an effort to track and/or follow satellite 540.

In some examples, steerable antenna 502 may steer, direct, and/or aim boresight 506 in accordance with an antenna coordinate system 504. In one example, antenna coordinate system 504 may implement and/or operate an overall pointing formula of $(\theta_{el_m}, \psi_{as_m})=f(\theta_{eltp}, \psi_{azbp})$, which facilitates mapping angles of boresight 506 to the displacement angles of the azimuth and elevation motors. This pointing formula may lead to an azimuth formula of $$\theta = \operatorname{asin}\left(2 \sin\left(\frac{\theta_r}{2}\right)\right)$$

and/or an elevation formula of $$\phi = \left(\frac{\theta_r}{2} + \operatorname{sign}(\theta_r) \times 90\right).$$

As a specific example, satellite 540 may be located at and/or passing through an azimuth angle of 0 degrees and an elevation angle of 37 degrees. In this example, for the worst case scenario of travelling within 53 degrees of the zenith, steerable antenna 502 may compute and/or determine the angular displacement of two plates as elevation angle=$37° \rightarrow \theta_r=47° \rightarrow \theta_{el_m}=47°$ and azimuth angle=$0° \rightarrow \phi=113° \rightarrow \theta_{az_m}=23°$.

As another example, satellite 540 may be located at and/or passing through an azimuth angle of 180 degrees and an elevation angle of 37 degrees. In this example, for the worst case scenario of travelling within 53 degrees of the zenith, steerable antenna 502 may compute and/or determine the angular displacement of two plates as elevation angle=$37° \rightarrow \theta_r=-47°$ and azimuth angle=$180° \rightarrow \phi=-113°$.

In one example, antenna coordinate system 504 may include and/or represent a body coordinate frame denoted in FIG. 12 with the subscript "B" and a pointing coordinate frame denoted in FIG. 12 with the subscript "P". In this example, the body coordinate frame may be right-handed with the z-axis pointing downward, and the pointing coordinate frame may be right-handed with the z-axis pointing upward. Additionally or alternatively, boresight 506 may be defined and/or aimed by (1) an elevation angle positioned between the beam-pointing vector and the $x_p y_p$ plane and (2) an azimuth angle measured from the $x_p$ axis.

Figure 13:
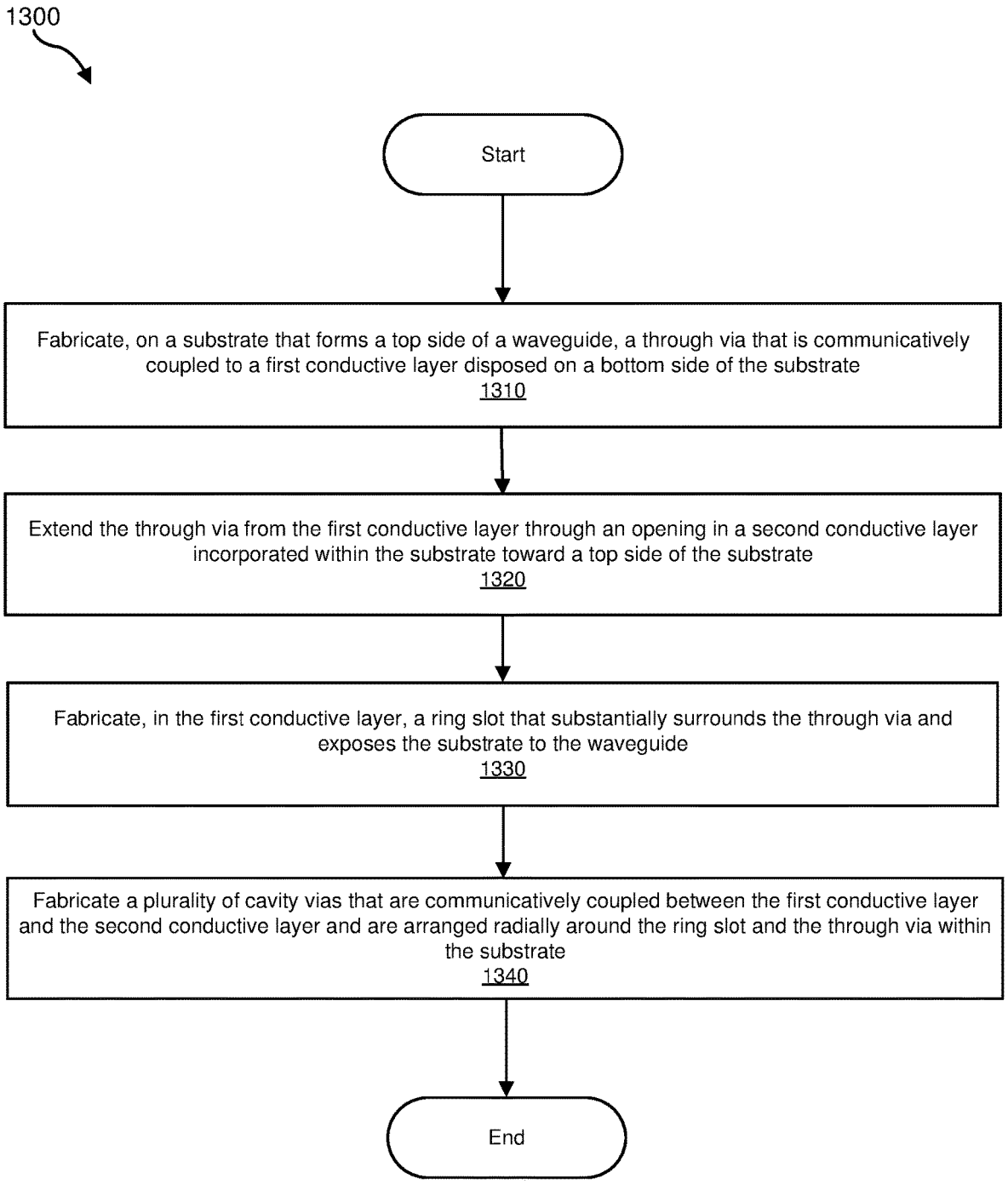
FIG. 13 is a flow diagram of an exemplary method of assembling an apparatus for transferring RF signals between a waveguide and a radiating element in an antenna in accordance with one or more embodiments of this disclosure.

FIG. 13 is a flow diagram of an exemplary method 1300 for facilitating the transfer of RF signals between waveguides and radiating elements in antennas. Method 1300 may include the step of fabricating, on a substrate that forms a top side of a waveguide, a through via that is communicatively coupled to a first conductive layer disposed on a bottom side of the substrate (1310). Step 1310 may be performed in a variety of ways, including any of those described above in connection with FIGS. 1-12. For example, a communications equipment vendor or subcontractor may fabricate and/or create, on a substrate that forms a top side of a waveguide, a through via that is communicatively coupled to a first conductive layer disposed on a bottom side of the substrate. Additionally or alternatively, an antenna fabrication system may fabricate and/or create, on a substrate that forms a top side of a waveguide, a through via that is communicatively coupled to a first conductive layer disposed on a bottom side of the substrate.

Method 1300 may also include the step of extending the through via from the first conductive layer through an opening in a second conductive layer incorporated within the substrate toward a top side of the substrate (1320). Step 1320 may be performed in a variety of ways, including any of those described above in connection with FIGS. 1-12. For example, the communications equipment vendor or subcontractor may extend the through via from the first conductive layer through an opening in a second conductive layer incorporated within the substrate toward a top side of the substrate. Additionally or alternatively, the antenna fabrication system may extend the through via from the first conductive layer through an opening in a second conductive layer incorporated within the substrate toward a top side of the substrate.

Method 1300 may further include the step of fabricating, in the first conductive layer, a ring slot that substantially surrounds the through via and exposes the substrate to the waveguide (1330). Step 1330 may be performed in a variety of ways, including any of those described above in connection with FIGS. 1-12. For example, the communications equipment vendor or subcontractor may fabricate and/or create, in the first conductive layer, a ring slot that substantially surrounds the through via and exposes the substrate to the waveguide. Additionally or alternatively, the antenna fabrication system may fabricate and/or create, in the first conductive layer, a ring slot that substantially surrounds the through via and exposes the substrate to the waveguide.

Method 1300 may further include the step of fabricating a plurality of cavity vias that are communicatively coupled between the first conductive layer and the second conductive layer and/or are arranged radially around the ring slot and the through via within the substrate (1340). Step 1340 may be performed in a variety of ways, including any of those described above in connection with FIGS. 1-12. For example, the communications equipment vendor or subcontractor may fabricate and/or create a plurality of cavity vias that are communicatively coupled between the first conductive layer and the second conductive layer and/or are arranged radially around the ring slot and the through via within the substrate. Additionally or alternatively, the antenna fabrication system may fabricate and/or create a plurality of cavity vias that are communicatively coupled between the first conductive layer and the second conductive layer and/or are arranged radially around the ring slot and the through via within the substrate.

EXAMPLE EMBODIMENTS

Example 1

An RF coupling structure comprising (1) a substrate that forms a top side of a waveguide, (2) a first conductive layer disposed on a bottom side of the substrate, (3) a second conductive layer incorporated within the substrate, (4) a through via that is communicatively coupled to the first conductive layer and extends through an opening in the second conductive layer toward a top side of the substrate, and/or (5) a ring slot formed around the through via in the first conductive layer.

Example 2

The RF coupling structure of Example 1, further comprising a plurality of cavity vias communicatively coupled between the first conductive layer and the second conductive layer.

Example 3

The RF coupling structure of either of Examples 1 and 2, wherein the cavity vias are arranged radially around the ring slot and the through via within the substrate.

Example 4

The RF coupling structure of any of Examples 1-3, wherein a top side of the substrate is coupled to a radiating element configured to radiate energy in accordance with radio frequency signals traversing the waveguide.

Example 5

The RF coupling structure of any of Examples 1-4, wherein the ring slot exposes the substrate to the waveguide.

Example 6

The RF coupling structure of any of Examples 1-5, wherein the ring slot comprises a whole annular slot that completely encompasses the through via in the first conductive layer.

Example 7

The RF coupling structure of any of Examples 1-6, wherein the ring slot (1) encompasses a majority of the through via in the first conductive layer and (2) includes a break in which conductive material from the first conductive layer remains.

Example 8

The RF coupling structure of any of Examples 1-7, further comprising an additional ring slot formed around the through via and the ring slot in the first conductive layer, wherein the additional ring slot exposes the substrate to the waveguide.

Example 9

The RF coupling structure of any of Examples 1-8, wherein the additional ring slot (1) encompasses a majority of the through via in the first conductive layer, (2) encompasses a majority of the ring slot, and (3) includes an additional break in which conductive material from the first conductive layer remains.

Example 10

The RF coupling structure of any of Examples 1-9, wherein (1) the ring slot is oriented such that the break faces a specific direction relative to the through via and (2) the additional ring slot is oriented such that the additional break faces the specific direction relative to the through via.

Example 11

The RF coupling structure of any of Examples 1-10, wherein (1) the ring slot is oriented such that the break faces a specific direction relative to the through via and (2) the additional ring slot is oriented such that the additional break faces an additional direction relative to the through via, wherein the additional direction is substantially opposite the specific direction.

Example 12

An antenna comprising (1) a bottom RF guide plate rotatably coupled to a base via a first shaft controlled by an azimuth motor, (2) a top array plate rotatably coupled to the base via a second shaft controlled by an elevation motor, the top array plate and the bottom RF guide plate collectively forming a waveguide configured to direct radio frequency signals in a specific direction, and (3) a plurality of radio frequency coupling structures disposed on a substrate of the top array plate, each radio frequency coupling structure included in the plurality comprising (A) a first conductive layer disposed on a bottom side of the substrate, (B) a second conductive layer incorporated within the substrate, (C) a through via that is communicatively coupled to the first conductive layer and extends through an opening in the second conductive layer toward a top side of the substrate, and (D) a ring slot formed around the through via in the first conductive layer.

Example 13

The antenna of Example 12, wherein each radio frequency coupling structure comprises a plurality of cavity vias communicatively coupled between the first conductive layer and the second conductive layer.

Example 14

The antenna of either of Examples 12 and 13, wherein the cavity vias are arranged radially around the ring slot and the through via within the substrate.

Example 15

The antenna of any of Examples 12-14, wherein a top side of the substrate is coupled to a radiating element configured to radiate energy in accordance with radio frequency signals traversing the waveguide.

Example 16

The antenna of any of Examples 12-15, wherein the ring slot exposes the substrate to the waveguide.

Example 17

A method may comprise (1) fabricating, on a substrate that forms a top side of a waveguide, a through via that is communicatively coupled to a first conductive layer disposed on a bottom side of the substrate, (2) extending the through via from the first conductive layer through an opening in a second conductive layer incorporated within the substrate toward a top side of the substrate, (3) fabricating, in the first conductive layer, a ring slot that substantially surrounds the through via and exposes the substrate to the waveguide, (4) fabricating a plurality of cavity vias that (A) are communicatively coupled between the first conductive layer and the second conductive layer and (B) are arranged radially around the ring slot and the through via within the substrate.

Example 18

The method of Example 17, further comprising coupling the top side of the substrate to a radiating element configured to radiate energy in accordance with radio frequency signals traversing the waveguide.

Example 19

The method of either of Examples 17 and 18, wherein fabricating the ring slot comprises fabricating a whole annular slot that completely encompasses the through via in the first conductive layer.

Example 20

The method of any of Examples 17-20, wherein fabricating the ring slot comprises fabricating the ring slot to (1) encompass a majority of the through via in the first conductive layer and (2) include a break in which conductive material from the first conductive layer remains.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to any claims appended hereto and their equivalents in determining the scope of the present disclosure.

Unless otherwise noted, the terms "connected to" and "coupled to" (and their derivatives), as used in the specification and/or claims, are to be construed as permitting both direct and indirect (i.e., via other elements or components) connection. In addition, the terms "a" or "an," as used in the specification and/or claims, are to be construed as meaning "at least one of." Finally, for ease of use, the terms "including" and "having" (and their derivatives), as used in the specification and/or claims, are interchangeable with and have the same meaning as the word "comprising."

What is claimed is:

1. A radio frequency coupling structure comprising:

a substrate that forms a top side of a waveguide;

a first conductive layer disposed on a bottom side of the substrate;

a second conductive layer incorporated within the substrate;

a through via that is communicatively coupled to the first conductive layer and extends through an opening in the second conductive layer toward a top side of the substrate; and a ring slot formed around the through via in the first conductive layer.

2. The radio frequency coupling structure of claim 1, further comprising a plurality of cavity vias communicatively coupled between the first conductive layer and the second conductive layer.

3. The radio frequency coupling structure of claim 2, wherein the cavity vias are arranged radially around the ring slot and the through via within the substrate.

4. The radio frequency coupling structure of claim 2, wherein the top side of the substrate is coupled to a radiating element configured to radiate energy in accordance with radio frequency signals traversing the waveguide.

5. The radio frequency coupling structure of claim 1, wherein the ring slot exposes the substrate to the waveguide.

6. The radio frequency coupling structure of claim 1, wherein the ring slot comprises a whole annular slot that completely encompasses the through via in the first conductive layer.

7. The radio frequency coupling structure of claim 1, wherein the ring slot:

encompasses a majority of the through via in the first conductive layer; and includes a break in which conductive material from the first conductive layer remains.

8. The radio frequency coupling structure of claim 7, further comprising an additional ring slot formed around the through via and the ring slot in the first conductive layer, wherein the additional ring slot exposes the substrate to the waveguide.

9. The radio frequency coupling structure of claim 8, wherein the additional ring slot:

encompasses a majority of the through via in the first conductive layer;

encompasses a majority of the ring slot; and includes an additional break in which conductive material from the first conductive layer remains.

10. The radio frequency coupling structure of claim 9, wherein:

the ring slot is oriented such that the break faces a specific direction relative to the through via; and the additional ring slot is oriented such that the additional break faces the specific direction relative to the through via.

11. The radio frequency coupling structure of claim 9, wherein:

the ring slot is oriented such that the break faces a specific direction relative to the through via; and the additional ring slot is oriented such that the additional break faces an additional direction relative to the through via, wherein the additional direction is substantially opposite the specific direction.

12. An antenna comprising:

a bottom Radio Frequency (RF) guide plate rotatably coupled to a base via a first shaft controlled by an azimuth motor;

a top array plate rotatably coupled to the base via a second shaft controlled by an elevation motor, the top array plate and the bottom RF guide plate collectively forming a waveguide configured to direct radio frequency signals in a specific direction; and a plurality of radio frequency coupling structures disposed on a substrate of the top array plate, the plurality of radio frequency coupling structures comprising:

a first conductive layer disposed on a bottom side of the substrate;

a second conductive layer incorporated within the substrate;

a through via that is communicatively coupled to the first conductive layer and extends through an opening in the second conductive layer toward a top side of the substrate; and a ring slot formed around the through via in the first conductive layer.

13. The antenna of claim 12, wherein the plurality of radio frequency coupling structures comprise a plurality of cavity vias communicatively coupled between the first conductive layer and the second conductive layer.

14. The antenna of claim 13, wherein the cavity vias are arranged radially around the ring slot and the through via within the substrate.

15. The antenna of claim 12, wherein the top side of the substrate is coupled to a radiating element configured to radiate energy in accordance with radio frequency signals traversing the waveguide.

16. The antenna of claim 12, wherein the ring slot exposes the substrate to the waveguide.

17. A method comprising:

fabricating, on a substrate that forms a top side of a waveguide, a through via that is communicatively coupled to a first conductive layer disposed on a bottom side of the substrate;

extending the through via from the first conductive layer through an opening in a second conductive layer incorporated within the substrate toward a top side of the substrate;

fabricating, in the first conductive layer, a ring slot that substantially surrounds the through via and exposes the substrate to the waveguide; and fabricating a plurality of cavity vias that:

are communicatively coupled between the first conductive layer and the second conductive layer; and are arranged radially around the ring slot and the through via within the substrate.

18. The method of claim 17, further comprising coupling the top side of the substrate to a radiating element configured to radiate energy in accordance with radio frequency signals traversing the waveguide.

19. The method of claim 17, wherein fabricating the ring slot comprises fabricating a whole annular slot that completely encompasses the through via in the first conductive layer.

20. The method of claim 17, wherein fabricating the ring slot comprises fabricating the ring slot to:

encompass a majority of the through via in the first conductive layer; and include a break in which conductive material from the first conductive layer remains.

* * * * *